US011561025B2

(12) United States Patent
Adachi et al.

(10) Patent No.: US 11,561,025 B2
(45) Date of Patent: Jan. 24, 2023

(54) AIR-CONDITIONING APPARATUS

(71) Applicant: Mitsubishi Electric Corporation, Chiyoda-ku (JP)

(72) Inventors: Rihito Adachi, Chiyoda-ku (JP); Yoji Onaka, Chiyoda-ku (JP); Makoto Tanishima, Chiyoda-ku (JP); Hiroki Fukuoka, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 127 days.

(21) Appl. No.: 16/763,416

(22) PCT Filed: Nov. 16, 2018

(86) PCT No.: PCT/JP2018/042405

§ 371 (c)(1),
(2) Date: May 12, 2020

(87) PCT Pub. No.: WO2019/116820

PCT Pub. Date: Jun. 20, 2019

(65) Prior Publication Data

US 2020/0284468 A1 Sep. 10, 2020

(30) Foreign Application Priority Data

Dec. 13, 2017 (JP) ..... JP2017-238777

(51) Int. Cl.
*F24F 13/30* (2006.01)
*F24F 13/06* (2006.01)
*F24F 13/20* (2006.01)

(52) U.S. Cl.
CPC ..... *F24F 13/30* (2013.01); *F24F 13/06* (2013.01); *F24F 13/20* (2013.01); *F24F 2013/205* (2013.01)

(58) Field of Classification Search
CPC .... F24F 13/30; F24F 2013/205; F24F 1/0022; F24F 13/20; F24F 1/0063; F24F 1/18;
(Continued)

(56) References Cited

U.S. PATENT DOCUMENTS

2005/0205238 A1* 9/2005 Terada
2012/0145364 A1 6/2012 Oritani et al.

FOREIGN PATENT DOCUMENTS

EP 2902717 A1 * 8/2015 ..... F25B 13/00
EP 2902717 A1 8/2015
(Continued)

OTHER PUBLICATIONS

English Translation of JPH11241616A—Translated Dec. 9, 2021 (Year: 2021).*
(Continued)

*Primary Examiner* — Edelmira Bosques
*Assistant Examiner* — Brett Peterson Mallon
(74) *Attorney, Agent, or Firm* — Xsensus LLP

(57) ABSTRACT

An air-conditioning apparatus includes: a housing having an intake air passage communicating with an air inlet and a blowout air passage communicating with an air outlet that allows air to be blown out in a single direction; a fan; a front heat exchanger facing the air outlet of the housing and including first and second heat exchangers; and at least one of rear and side heat exchangers that face rear and side surfaces of the housing, respectively. When the front heat exchanger operates as a condenser, the first heat exchanger operates as a condenser, and condensed and liquified refrigerant flows in the second heat exchanger. The second heat exchanger is located downstream of the first heat exchanger and the at least one of the rear and side heat exchangers in the flow direction of a refrigerant.

14 Claims, 23 Drawing Sheets

(58) Field of Classification Search
CPC ..... F24F 1/16; F24F 1/0067; F24F 1/0018; F24F 13/06; F24F 1/00
See application file for complete search history.

(56) References Cited

FOREIGN PATENT DOCUMENTS

| | | | | | |
|---|---|---|---|---|---|
| GB | 1572243 | A | * | 7/1980 | ..... F24H 3/081 |
| GB | 1572243 | A | | 7/1980 | |
| JP | H11241616 | A | * | 9/1999 | |
| JP | 2000-356362 | A | | 12/2000 | |
| JP | 2006-336909 | A | | 12/2006 | |
| JP | 2006336909 | A | * | 12/2006 | |
| JP | 2008-196811 | A | | 8/2008 | |
| JP | 2014-228223 | A | | 12/2014 | |
| JP | 2018-100803 | A | | 6/2018 | |
| WO | WO-2017165924 | A1 | * | 10/2017 | ..... F28D 1/0426 |

OTHER PUBLICATIONS

English Translation of JP-2006336909-A—Translated Dec. 9, 2021 (Year: 2021).*
International Search Report dated Jan. 29, 2019 in PCT/JP2018/042405 filed Nov. 16, 2018.
Extended European search report dated Dec. 23, 2020, in corresponding European patent Application No. 18889164.2, 9 pages.

* cited by examiner

SPEED OF AIR AT EACH OF DIFFERENT POSITIONS IN HEIGHT DIRECTION OF FRONT HEAT EXCHANGER

AIR-CONDITIONING APPARATUS

TECHNICAL FIELD

The present disclosure relates to an air-conditioning apparatus that includes a heat exchanger and a fan.

BACKGROUND ART

For example, Patent Literatures 1 and 2 disclose an air-conditioning apparatus in which heat exchangers are disposed in such a manner as to surround a fan in order to improve the heat exchange efficiency.

The air-conditioning apparatus disclosed in Patent Literature 1 includes indoor heat exchangers that are disposed around a centrifugal fan employed as the above fan and in a substantially quadrangular manner, and that have air inlets and air outlets formed in lower surfaces of the indoor heat exchangers.

The air-conditioning apparatus disclosed in Patent Literature 2 includes indoor heat exchangers that are disposed on left and right sides of a centrifugal fan employed as the above fan, and that have air inlets and air outlets formed in front surfaces of the indoor heat exchangers.

CITATION LIST

Patent Literature

Patent Literature 1: Japanese Unexamined Patent Application Publication No. 2014-228223

Patent Literature 2: Japanese Unexamined Patent Application Publication No. 2006-336909

SUMMARY OF INVENTION

Technical Problem

The air-conditioning apparatus disclosed in Patent Literature 1 has a structure in which an air inlet and an air outlet are provided in a single surface, and an extension portion is newly provided at a position which is close to the fan and at which air flows at a relatively high speed.

The air-conditioning apparatus disclosed in Patent Literature 2 has a structure in which an air inlet and an air outlet are provided in a single surface, and a subcooling portion is newly provided at a position which is close to the fan and at which air flows at a relatively high speed.

However, these air-conditioning apparatuses are not designed on the assumption that their housings have a structure in which the variation between the speeds of air that flows through different regions is greater.

For example, an air-conditioning apparatus that sucks air therein from a lower surface of the air-conditioning apparatus and blows air from a side surface of the air-conditioning apparatus employs a centrifugal fan as an air-sending device. The centrifugal fan blows the sucked air in a circumferential direction, which is perpendicular to a direction in which the air is sucked. In general, such an air-conditioning apparatus has only one air outlet. Since only one air outlet is provided, air blown from the fan in the circumferential direction is not uniformly guided to the air outlet. To be more specific, in such an air-conditioning apparatus, because of a pressure loss in each of air passages, the amount of air that passes through a heat exchanger located far from the air outlet is small and that of air that passes through a heat exchanger located close to the air outlet is large. Therefore, in an air-conditioning apparatus in which an air outlet is not provided symmetrically with respect to a fan as in an air-conditioning apparatus in which only one air outlet is provided, the heat exchange efficiency is reduced because of the variation between the speeds of air that pass through the heat exchangers.

As described above, the air-conditioning apparatuses disclosed in Patent Literatures 1 and 2 are not provided on the assumption that an air outlet is not provided symmetrically with respect to the fan, and thus cannot handle reduction of the heat exchange efficiency that is caused by the variation between the speeds of air that passes through heat exchangers. That is, in the air-conditioning apparatuses disclosed in Patent Literatures 1 and 2, in the case where an air outlet is not provided symmetrically with respect to the fan, subcooling obtained in an extension portion and a subcooling portion is not uniform because of the variation between the speeds of air that pass through the heat exchangers, thus causing reduction of the heat exchange efficiency.

Embodiments of the present disclosure are provided to solve the above problem, and the present disclosure relates to an air-conditioning apparatus that can efficiently achieve subcooling and thus reduce the degree of reduction of the heat exchange efficiency even in the case where an air outlet is not provided symmetrically with respect to a fan.

Solution to Problem

An air-conditioning apparatus includes: a housing in which an intake air passage and a blowout air passage are provided, the intake air passage communicating with an air inlet, the blowout air passage communicating with an air outlet that allows air to be blown out in a single direction; a fan provided in the housing to suck air from the air inlet and blow out air from the air outlet; a front heat exchanger provided to face the air outlet of the housing; and at least one of a rear heat exchanger and a side heat exchanger, the rear heat exchanger being provided to face a rear surface of the housing, the side heat exchanger being provided to face a side surface of the housing. The fan blows air that is sucked into the fan from the air inlet and the intake air passage, in a circumferential direction perpendicular to a direction in which the air is sucked into the fan, such that the air is blown out from the air outlet through the blowout air passage. The front heat exchanger includes a first heat exchanger and a second heat exchanger, and when the front heat exchanger operates as a condenser, the first heat exchanger operates as a condenser, and in the second heat exchanger, condensed and liquified refrigerant flows. When the front heat exchanger and the at least one of the rear heat exchanger and the side heat exchanger operate as condensers, the second heat exchanger is located downstream of the first heat exchanger and the at least one of the rear heat exchanger and the side heat exchanger in a flow direction of refrigerant.

ADVANTAGEOUS EFFECTS OF INVENTION

In the air-conditioning apparatus according to the embodiment of the present disclosure, the front heat exchanger is provided to face the air outlet, and includes the second heat exchanger through which condensed and liquified refrigerant flows. It is therefore possible to efficiently subcool refrigerant and reduce the degree of a decrease in the heat exchange efficiency.

DESCRIPTION OF EMBODIMENTS

Embodiments of the present disclosure will be described with reference to the drawings. Relationships in size between components illustrated in figures as indicated below and including FIG. 1 may be different from those in actual components. In each of the figures including FIG. 1, components which are the same as or equivalent to those in a previous figure are denoted by the same reference signs, and the same is true of the entire text of the specification. Forms of the components described in the entire text of the specification are examples, that is, the forms of the components are not limited to the described ones. Furthermore, shapes, sizes, and positions of the components in the figures can be changed as appropriate without departing from the scope of the present disclosure.

Embodiment 1

Figure 1:
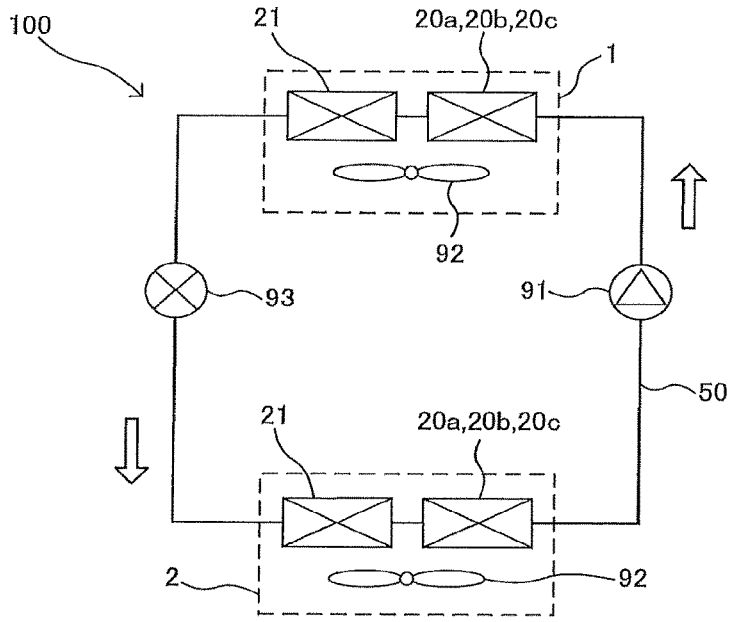
FIG. 1 is a configuration diagram schematically illustrating an example of a configuration of a refrigerant circuit of an air-conditioning apparatus according to Embodiment 1 of the present disclosure.
Figure 2:
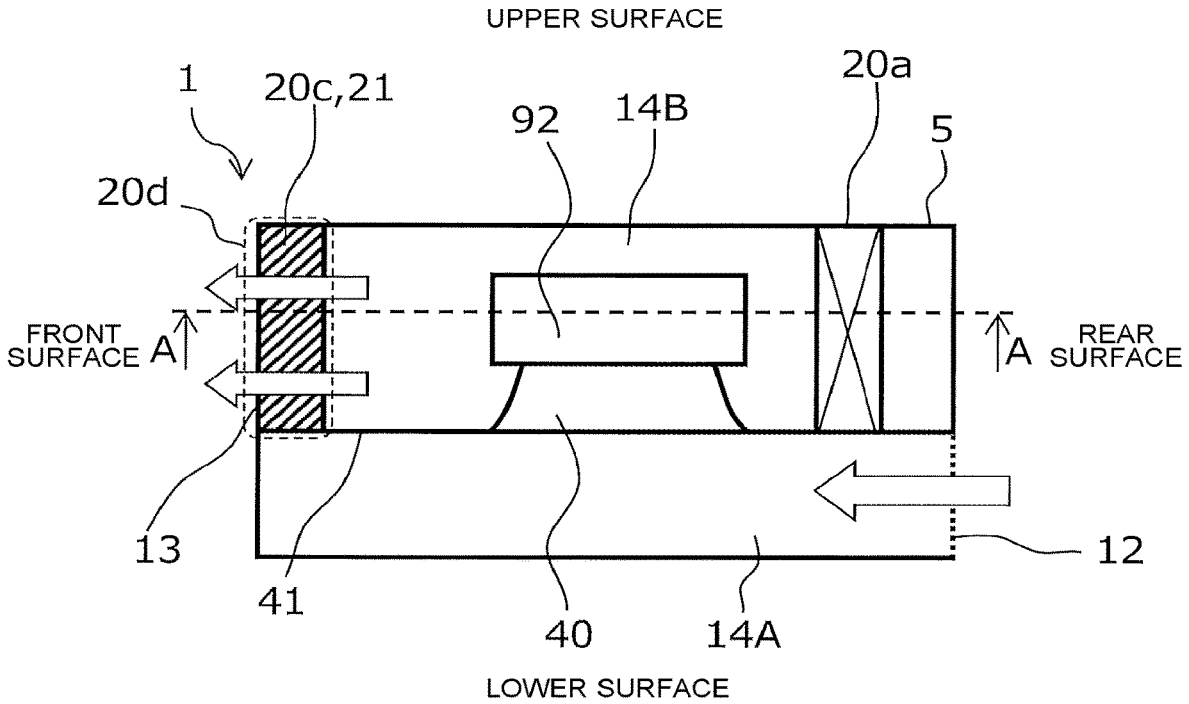
FIG. 2 is a side view schematically illustrating a condensation unit of the air-conditioning apparatus according to Embodiment 1 of the present disclosure.
Figure 3:
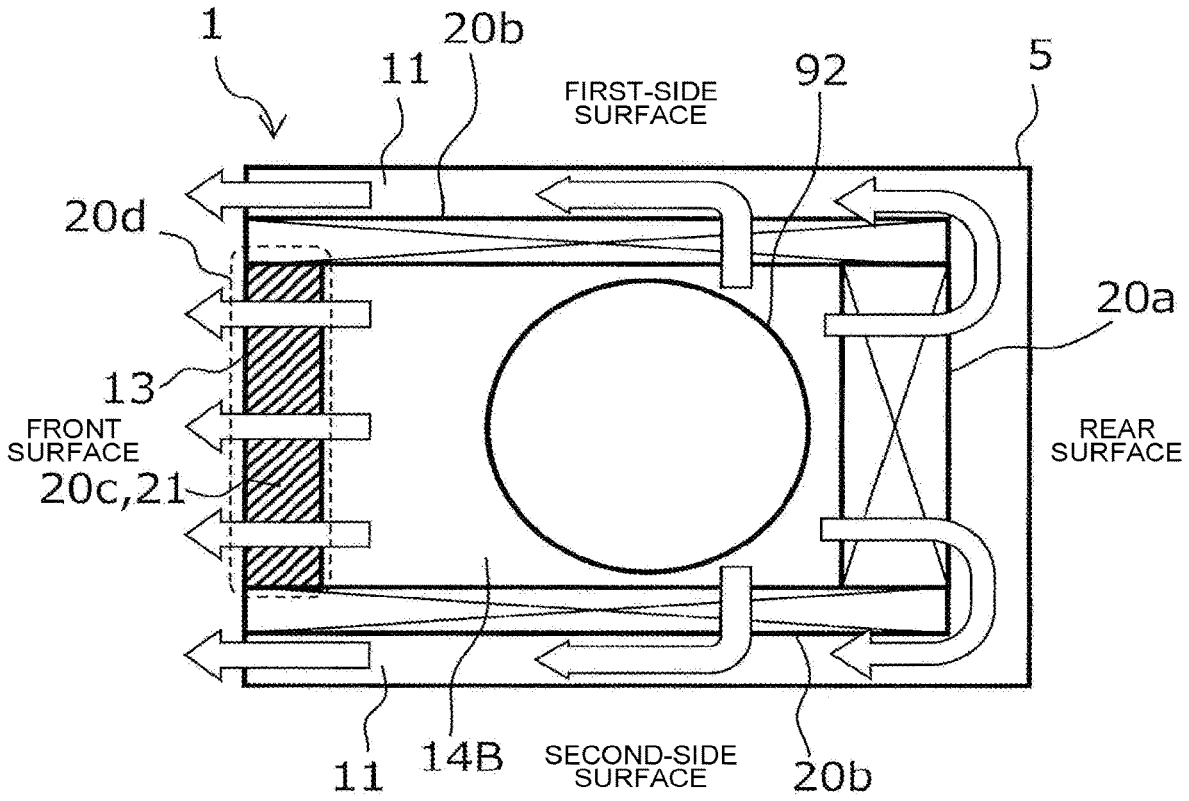
FIG. 3 is a cross-sectional view schematically illustrating an example of a cross section taken along line A-A in FIG. 2.

FIG. 1 is a configuration diagram schematically illustrating an example of the configuration of a refrigerant circuit of an air-conditioning apparatus 100 according to Embodiment 1 of the present disclosure. FIG. 2 is a side view schematically illustrating a condensation unit 1 of the air-conditioning apparatus 100. FIG. 3 is a cross-sectional view schematically illustrating an example of a cross section taken along line A-A in FIG. 2. The air-conditioning apparatus 100 will be described below with reference to FIGS. 1 to 3. It should be noted that in FIG. 1, the flow of refrigerant is indicated by arrows, and in FIGS. 2 and 3, the flows of air are indicated by arrows.

The air-conditioning apparatus 100 is a ceiling-embedded air-conditioning apparatus. Regarding Embodiment 1, in the following example, the condensation unit 1 is a heat source unit, and an evaporation unit 2 is an indoor unit. However, the condensation unit 1 may be an indoor unit, and the evaporation unit 2 may be a heat source unit. As a matter of convenience, in the figures from FIG. 2 onward, the condensation unit 1 is illustrated, but the evaporation unit 2 is not illustrated. However, the evaporation unit 2 has the same configuration as the condensation unit 1.

It should be noted that on the right side, left side, upper side, and lower side of FIG. 2, a rear surface, a front surface, an upper side, and lower side of the condensation unit 1 are located, respectively; and on the right side, left side, upper side, and lower side of FIG. 3, a rear surface, a front surface, a first side surface, and a second side surface of the condensation unit 1 are located, respectively.

The air-conditioning apparatus 100 according to Embodiment 1 is used to heat or cool an air-conditioned space such as a room of a house, a building, or an apartment. The air-conditioning apparatus 100 includes, for example, the condensation unit 1 and the evaporation unit 2 connected to the condensation unit 1. The condensation unit 1 is embedded in a ceiling, and the evaporation unit 2 is provided in, for example, a room that is an air-conditioned space.

Although FIG. 1 illustrates an example in which a single evaporation unit 2 is connected to a single condensation unit 1, the number of condensation units 1 and the number of evaporation units 2 are not limited.

The condensation unit 1 and the evaporation unit 2 each includes a rear heat exchanger 20*a*, side heat exchangers 20*b*, a first heat exchanger 20*c*, a second heat exchanger 21, and a fan 92. These components are housed in a housing 5 that forms the entire outer peripheral portion of the condensation unit 1 or the evaporation unit 2. The housing 5 has an air inlet 12 and an air outlet 13 that are each provided in any of surfaces of the housing 5. Furthermore, in the housing 5, side air passages 11 are provided to guide air that has passed though the rear heat exchanger 20*a* and the side heat exchangers 20*b* to the air outlet 13. Although it is described above that the rear heat exchanger 20*a* and the side heat exchangers 20*b* are provided, it suffices that at least one of the rear heat exchanger 20*a* and a side heat exchanger pair, that is, the side heat exchangers 20*b*, is provided.

The rear heat exchanger 20*a*, the side heat exchangers 20*b*, the first heat exchanger 20*c*, and the second heat exchanger 21 are provided in such a manner as to face respective four surfaces of the housing 5 and surround the fan 92, as illustrated in, for example, FIG. 3. The rear heat exchanger 20*a* faces the rear surface of the housing 5. The side heat exchangers 20*b* face the first side surface and the second side surface of the housing 5. The first heat exchanger 20*c* and the second heat exchanger 21 face the front surface of the housing 5.

The rear heat exchanger 20*a*, the side heat exchangers 20*b*, the first heat exchanger 20*c*, and the second heat exchanger 21 each include a plurality of heat transfer tubes, a plurality of fins, and refrigerant distributors connected to ends of the plurality of heat transfer tubes. The heat transfer tubes are circular tubes whose flow passages have a circular cross section or flat tubes whose flow passages have an elongated cross section. The fins are plate-shaped metal members. The fins may be corrugated or formed in the shape of a flat plate. The refrigerant distributors are connected to refrigerant inlet-side ends of the heat transfer tubes and refrigerant outlet-side ends of the heat transfer tubes. The refrigerant distributors serve not only as a refrigerant distributor, but as a refrigerant joining device.

It should be noted that the position, configuration and structure of the second heat exchanger 21 will be described later.

Regarding Embodiment 1, although it is described above by way of example that the rear heat exchanger 20*a*, the side heat exchangers 20*b*, the first heat exchanger 20*c*, and the second heat exchanger 21 are provided in such a manner as to surround the fan 92, this is not restrictive. It suffices that at least one of the rear heat exchanger 20*a* and the side heat exchanger pair, that is, the side heat exchangers 20*b*, is provided. Also, although it is described above by way of example that the rear heat exchanger 20*a*, the side heat exchangers 20*b*, the first heat exchanger 20*c*, and the second heat exchanger 21 are provided separate from each other, the rear heat exchanger 20*a*, the side heat exchangers 20*b*, the first heat exchanger 20*c*, and the second heat exchanger 21 may be formed continuous with each other in such a manner as to be, for example, L-shaped.

In consideration of the case where a condensing operation is being performed, the second heat exchanger 21 of the condensation unit 1 is located downstream of the rear heat exchanger 20*a*, the side heat exchangers 20*b*, and the first heat exchanger 20*c* in the flow direction of refrigerant, as illustrated in FIG. 1. Furthermore, the second heat exchanger 21 is provided close to the air outlet 13 and windward of the air outlet 13 in the flow direction of air supplied from the fan 92. During the condensing operation, the rear heat exchanger 20*a*, the side heat exchangers 20*b*, and the first heat exchanger 20*c* each operate as a condenser, and the second heat exchanger 21 operates as a subcooling heat exchanger.

Air that flows into the condensation unit 1 or the evaporation unit 2 from the air inlet 12 passes through an intake air passage 14A. Then, after passing through the fan 92, the air flows through a blowout air passage 14B and is supplied to the rear heat exchanger 20*a*, the side heat exchangers 20*b*, the first heat exchanger 20*c*, and the second heat exchanger 21. The air supplied to the rear heat exchanger 20*a* and the side heat exchangers 20*b* passes through the rear heat exchanger 20*a* and the side heat exchangers 20*b*, flows through the side air passage 11, and then flows out from the air outlet 13. The air supplied to the first heat exchanger 20*c* and the second heat exchanger 21 passes through the first heat exchanger 20*c* and the second heat exchanger 21, and flows out from the air outlet 13.

Although it is illustrated by way of example that the air inlet 12 is provided in the rear surface of the housing 5 that is opposite to the front surface of the housing 5 in which the air outlet 13 is provided, a positional relationship between the air inlet 12 and the air outlet 13 is not particularly limited. Each of the air inlet 12 and the air outlet 13 may be provided in any of the lower surface, upper surface, and side surfaces of the condensation unit 1.

The fan 92 has a shaft. When rotating around the shaft, the fan 92 sends air. The fan 92 is provided at a first partition plate 41, with a bell mouth 40 interposed between the fan 92 and the first partition plate 41. The fan 92 blows sucked air in a circumferential direction, which is perpendicular to a suction direction in which air is sucked. The shaft of the fan 92 extends in a direction that crosses the first partition plate 41. It is preferable that the shaft of the fan 92 extends in a direction perpendicular to the first partition plate 41. However, the shaft of the fan 92 does not need to be strictly perpendicular to the first partition plate 41.

The bell mouth 40 is provided on a suction side of the fan 92, and guides air that flows through the intake air passage 14A to the fan 92. The bell mouth 40 has a diameter that gradually decreases from an inlet of the bell mouth 40 that communicates with the intake air passage 14A, toward the fan 92.

Also, it is appropriate that a drain pan is provided below the rear heat exchanger 20*a*, the side heat exchangers 20*b*, the first heat exchanger 20*c*, and the second heat exchanger 21.

The intake air passage 14A and the blowout air passage 14B are provided by partitioning the inside of the housing 5 by the first partition plate 41. That is, the first partition plate 41 is provided to partition the inside of the housing 5 into a lower region and an upper region, that is, the intake air passage 14A and the blowout air passage 14B. The first partition plate 41 has an opening that causes the intake air passage 14A and the fan 92 to communicate with each other. At a periphery of the opening, the bell mouth 40 is provided. It should be noted that it is described above that the inside of the housing 5 is partitioned into a lower region and an upper region. This description means that in the state illustrated in FIG. 2, the inside of the housing 5 is partitioned into a lower region and an upper region.

The intake air passage 14A is space where air that has passed through the air inlet 12 necessarily flows before sucked to the fan 92. As illustrated in FIG. 2, the intake air passage 14A is provided as the lower region of the housing 5 and communicates with the air inlet 12 to guide air taken in from the air inlet 12 to the bell mouth 40.

The blowout air passage 148 is space where air that has passed through the fan 92 necessarily flows. The blowout air passage 148 is provided as the upper region of the housing 5 and communicates with the air outlet 13 to guide air blown out from the fan 92 to the air outlet 13.

Other components of the air-conditioning apparatus 100 will be described. It should be noted that in the following description, the second heat exchanger 21, the rear heat exchanger 20*a*, the side heat exchangers 20*b*, and the first heat exchanger 20*c* provided in the condensation unit 1 are sometimes referred to as heat exchangers of the condensation unit 1; and similarly, the second heat exchanger 21, the rear heat exchanger 20*a*, the side heat exchangers 20*b*, and the first heat exchanger 20*c* are sometimes referred to as heat exchangers of the evaporation unit 2.

The air-conditioning apparatus 100 includes a compressor 91 and an expansion device 93. Also, the air-conditioning apparatus 100 includes a refrigerant circuit in which the compressor 91, the heat exchangers of the condensation unit 1, the expansion device 93, and the heat exchangers of the evaporation unit 2 are connected by refrigerant pipes 50.

The compressor 91 compresses refrigerant and discharges the compressed refrigerant. The compressor 91 is, for example, a rotary compressor, a scroll compressor, a screw compressor, or a reciprocating compressor.

The expansion device 93 reduce the pressure of refrigerant that has passed through the heat exchangers of the condensation unit 1. As the expansion device 93, for example, an electronic expansion valve can be used. Alternatively, as the expansion device 93, a flow resistive element obtained by combining a capillary tube, a valve, etc., may be used.

It will be described with reference to FIGS. 1 and 2 how the air-conditioning apparatus 100 having the above configuration operates during a cooling operation.

First, low-temperature, low-pressure gas refrigerant is sucked by the compressor 91, and compressed by the compressor 91 to change into high-temperature, high-pressure gas refrigerant. The high-temperature, high-pressure gas refrigerant is discharged from the compressor 91 and flows into the rear heat exchanger 20*a*, the side heat exchangers 20*b*, and the first heat exchanger 20*c* that are provided in the condensation unit 1. The high-temperature, high-pressure gas refrigerant that has flowed into the rear heat exchanger 20*a*, the side heat exchangers 20*b*, and the first heat exchanger 20*c* exchanges heat with air supplied from the fan 92, whereby the high-temperature, high-pressure gas refrigerant transfers heat, and condenses and liquifies. This refrigerant then flows as single-phase liquid refrigerant into the second heat exchanger 21.

In the second heat exchanger 21, the single-phase liquid refrigerant exchanges heat with air supplied from the fan 92 and is thus is subcooled to change into low-temperature, high-pressure liquid refrigerant. This low-temperature, high-pressure liquid refrigerant then flows out of the second heat exchanger 21. The liquid refrigerant that has flowed out of the second heat exchanger 21 is expanded and reduced in pressure by the expansion device 93 to change into low-temperature, low-pressure two-phase gas-liquid refrigerant. This low-temperature, low-pressure two-phase gas-liquid refrigerant then flows into the heat exchangers of the evaporation unit 2.

The two-phase gas-liquid refrigerant that has flowed into the heat exchangers of the evaporation unit 2 exchanges heat with indoor air supplied from the fan 92 of the evaporation unit 2 and thus removes heat from the indoor air to evaporate and change into low-temperature, low-pressure gas refrigerant. This low-temperature, low-pressure gas refrigerant then flows out of the evaporation unit 2. It should be noted that in the evaporation unit 2, the second heat exchanger 21, the rear heat exchanger 20*a*, the side heat exchangers 20*b*, and the first heat exchanger 20*c* are provided. The low-temperature, low-pressure gas refrigerant is re-sucked into the compressor 91, re-compressed by the compressor 91, and then discharged from the compressor 91. The above cycle of changes of the refrigerant is repeated.

Figure 4:
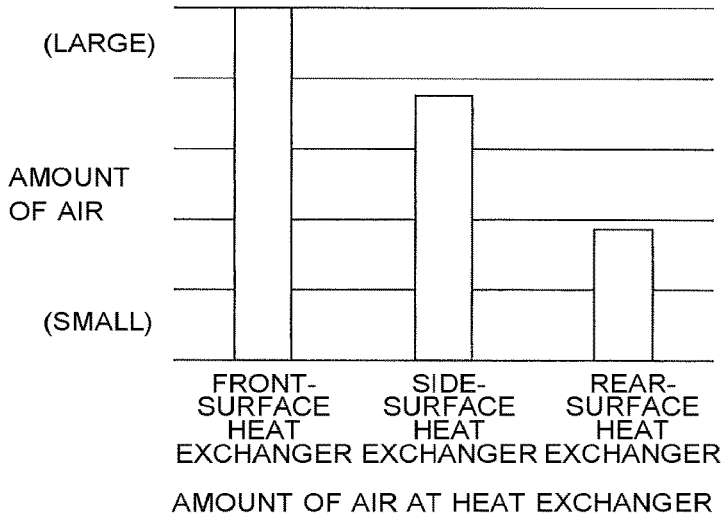
FIG. 4 is a graph indicating the variation between the amounts of air that passes through a rear heat exchanger, side heat exchangers, and a front heat exchanger in the condensation unit of the air-conditioning apparatus according to Embodiment 1 of the present disclosure.
Figure 5:
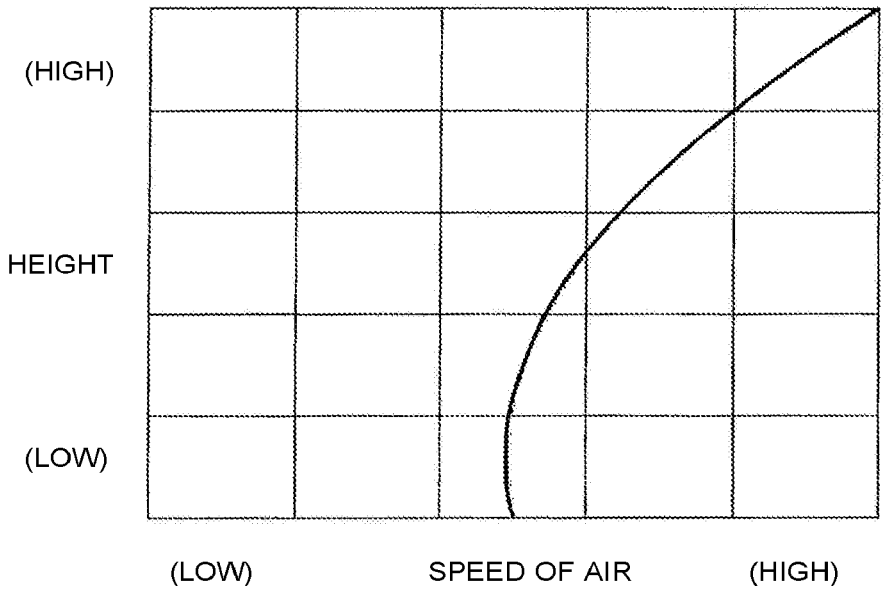
FIG. 5 is a graph indicating the variation between the speeds of air that passes through the front heat exchanger of the air-conditioning apparatus according to Embodiment 1 of the present disclosure, at different positions in the height direction of the front surface heat exchanger.

FIG. 4 is a graph indicating the variation between the amounts of air that passes through the rear heat exchanger 20*a*, the side heat exchangers 20*b*, and a front heat exchanger 20*d* in the condensation unit 1 of the air-conditioning apparatus 100. FIG. 5 is a graph indicating the variation between the speeds of air that passes through the front heat exchanger 20*d* of the air-conditioning apparatus 100, at different positions in the height direction of the front heat exchanger 20*d*. In the following description, a combination of the first heat exchanger 20*c* and the second heat exchanger 21 is referred to as the front heat exchanger 20*d*.

As indicated in FIG. 4, the amounts of air that passes though the rear heat exchanger 20*a*, the side heat exchangers 20*b*, and the front heat exchanger 20*d* vary, and the amount of air that passes through the front heat exchanger 20*d* is larger than the amounts of air that passes through the rear heat exchanger 20*a* and the side heat exchangers 20*b*. This is because the distances from the air outlet 13 to the rear heat exchanger 20*a*, the side heat exchangers 20*b*, and the front heat exchanger 20*d* are different from each other, and the flow amounts of air are determined such that the pressure losses of air that flows through these heat exchangers are equal to each other.

As illustrated in FIG. 5, at the different positions in the height direction of the front heat exchanger 20*d*, the speeds of air that passes through the front heat exchanger 20*d* vary, and the higher the position, the higher the speed of air. This is because an air outlet of the fan 92 is located at a position corresponding to the level of an upper portion of the front heat exchanger 20*d*.

As is clear from FIGS. 4 and 5, in the air-conditioning apparatus 100, the front heat exchanger 20*d* is located closest to the air outlet 13; that is, the front heat exchanger 20*d* is located in such a manner to face the air outlet 13. Furthermore, in the air-conditioning apparatus 100, the second heat exchanger 21 is located on the windward side as at least part of the front heat exchanger 20*d*. In addition, in the air-conditioning apparatus 100, the second heat exchanger 21 is located at a high position as the front heat exchanger 20*d*. Because of such a configuration, the second heat exchanger 21 can obtain a larger amount of air than the other heat exchangers and thereby efficiently subcool liquid refrigerant.

As described above, in the air-conditioning apparatus 100, the second heat exchanger 21 is located on the windward side in the vicinity of the air outlet 13. Because of this configuration, the air-conditioning apparatus 100 can obtain the following advantages. During the condensing operation, at the second heat exchanger 21, air flows at a higher speed than at the other heat exchangers, and the difference in temperature between refrigerant and air is great. Therefore, in the air-conditioning apparatus 100, the liquid refrigerant can be efficiently subcooled, and as a result the system performance is improved.

Next, the position, configuration, and structure of the second heat exchanger 21 will be described in detail.

Figure 6:
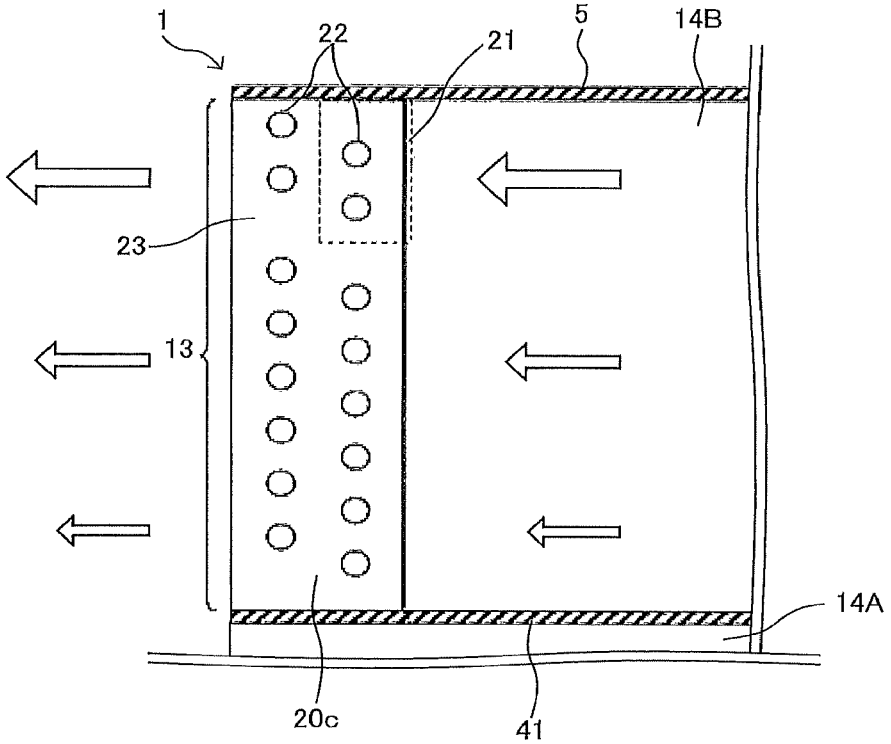
FIG. 6 is an enlarged partial cross-sectional view schematically illustrating an example of the front heat exchanger of the air-conditioning apparatus according to Embodiment 1 of the present disclosure.
Figure 7:
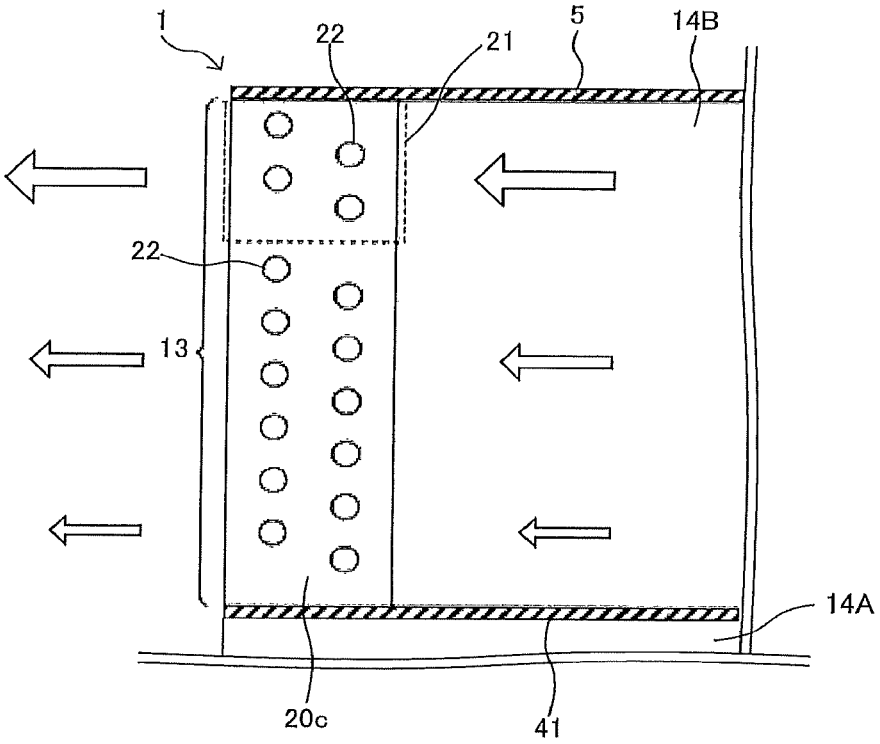
FIG. 7 is an enlarged partial cross-sectional view schematically illustrating another example of the front heat exchanger of the air-conditioning apparatus according to Embodiment 1 of the present disclosure.
Figure 8:
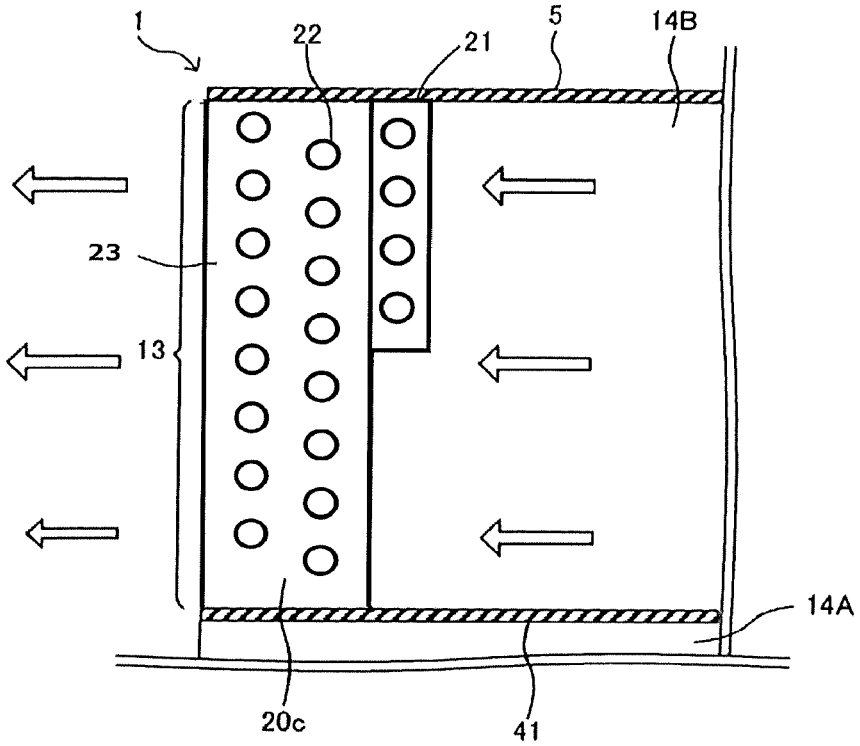
FIG. 8 is an enlarged partial cross-sectional view schematically illustrating still another example of the front heat exchanger of the air-conditioning apparatus according to Embodiment 1 of the present disclosure.

FIG. 6 is an enlarged partial cross-sectional view schematically illustrating an example of the front heat exchanger 20*d* of the air-conditioning apparatus 100. FIG. 7 is an enlarged partial cross-sectional view schematically illustrating another example of the front heat exchanger 20*d* of the air-conditioning apparatus 100. FIG. 8 is an enlarged cross-sectional view schematically illustrating still another example of the front heat exchanger 20*d* of the air-conditioning apparatus 100. In FIGS. 6 to 8, the flow of air is indicated by arrows.

As illustrated in FIG. 6, in the front heat exchanger 20*d* that includes the first heat exchanger 20*c* and the second heat exchanger 21, a plurality of heat transfer tubes 22 and heat transfer fins 23 can be provided. Tn the plurality of heat transfer tubes 22, flow passages having a circular cross section are--can be provided. As described above, the front heat exchanger 20*d* includes refrigerant distributors (not illustrated) that distribute refrigerant to the heat transfer tubes 22. Furthermore, the heat transfer tubes 22 may be flat tubes whose flow passages have an elongated cross section as described above. The first heat exchanger 20*c* and the second heat exchanger 21 may be separate heat exchangers or may be a single heat exchanger that shares the heat transfer fins 23 as illustrated in FIG. 6.

The first heat exchanger 20*c* is provided closest to the air outlet 13. The second heat exchanger 21 is provided at an upper stage of the front heat exchanger 20*d* and on the windward side as part of the front heat exchanger 20*d*. Because of such a configuration of the front heat exchanger 20*d*, at the second heat exchanger 21, air flows at a higher speed than at the first heat exchanger 20*c*, and the temperature difference between air and refrigerant is great. Therefore, the second heat exchanger 21 can efficiently subcool liquid refrigerant. It should be noted that the upper stage of the front heat exchanger 20*d* means an upper portion of the front heat exchanger 20*d* in a vertical direction when the front heat exchanger 20*d* is set.

However, the position of the second heat exchanger 21 is not limited to the position thereof as indicated in FIG. 6, and the second heat exchanger 21 may be provided, for example, as illustrated in FIG. 7 or 8. FIG. 7 illustrates an example in which the second heat exchanger 21 is provided at a higher level than the first heat exchanger 20*c* and located windward of the first heat exchanger 20*c*. FIG. 8 illustrates an example in which the second heat exchanger 21 is provided separate from the first heat exchanger 20*c*.

In the case where the second heat exchanger 21 is provided as illustrated in FIG. 7, air flows at a higher speed at the second heat exchanger 21 than in the configurations as illustrated in FIGS. 6 and 8. Therefore, when the second heat exchanger 21 operates as an evaporator, condensed water generated on a surface of the second heat exchanger 21 drops down and covers the first heat exchanger 20*c* provided at a lower position. As a result, the heat transfer performance is improved.

In the case where the second heat exchanger 21 is provided as illustrated in FIG. 8, heat is not transferred between the second heat exchanger 21 and the first heat exchanger 20*c*, and as a result, liquid refrigerant can be more efficiently subcooled. In this case, it is appropriate that the second heat exchanger 21 is provided in contact with an upper side of the blowout air passage 14B. In this configuration, a front surface area of the front heat exchanger 20d can be maximized, thereby improving the heat exchange efficiency. When the second heat exchanger 21 operates as an evaporator, a larger amount of condensed water is generated on the surface of the second heat exchanger 21 than on the first heat exchanger 20*c*. However, a component that hinders drainage of water is not present below the second heat exchanger 21, and the condensed water can be efficiently drained, and it is possible to prevent an increase in the flow loss of air. In addition, since the temperature difference between the refrigerant and air is greater, the refrigerant can be more efficiently subcooled. Furthermore, since the variation between the amount of air that passes through the front heat exchanger 20*d* at the difference different positions in the height direction of the front heat exchanger 20*d* can be reduced, the heat exchange efficiency can be improved.

Embodiment 2

Embodiment 2 of the present disclosure will be described below. With respect to Embodiment 2, components that are the same as or equivalent to those of Embodiment 1 will be denoted by the same reference signs, and of descriptions of the components, descriptions that are the same as those regarding Embodiment 1 will not be repeated.

Figure 9:
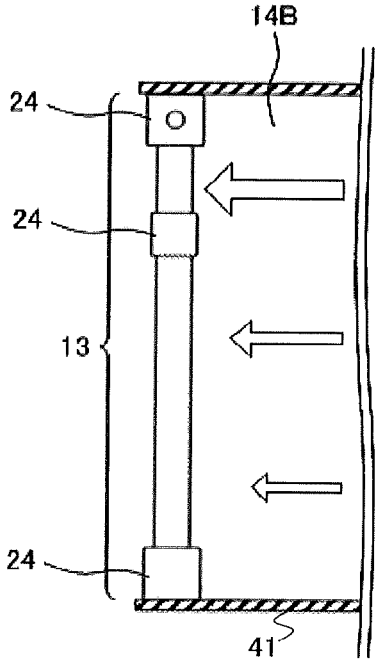
FIG. 9 is a side view for explaining an example of a front heat exchanger of an air-conditioning apparatus according to Embodiment 2 of the present disclosure.
Figure 10:
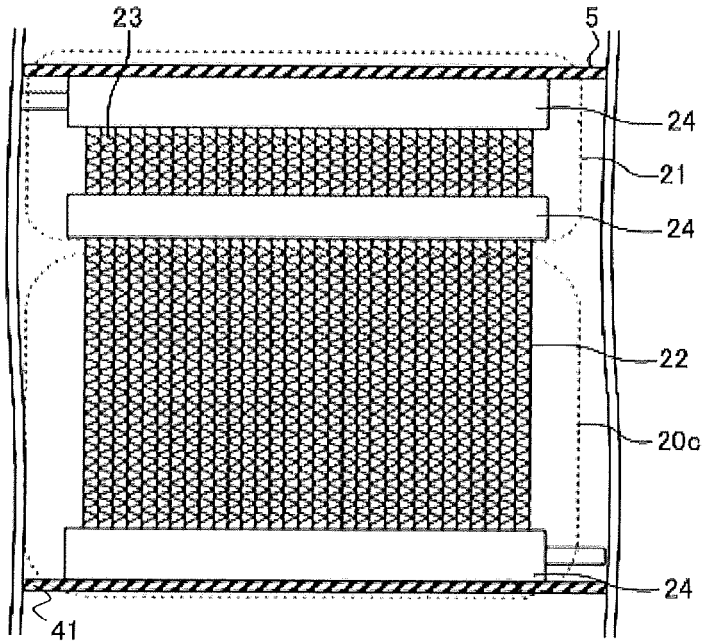
FIG. 10 is a back view of the front heat exchanger as illustrated in FIG. 9.
Figure 11:
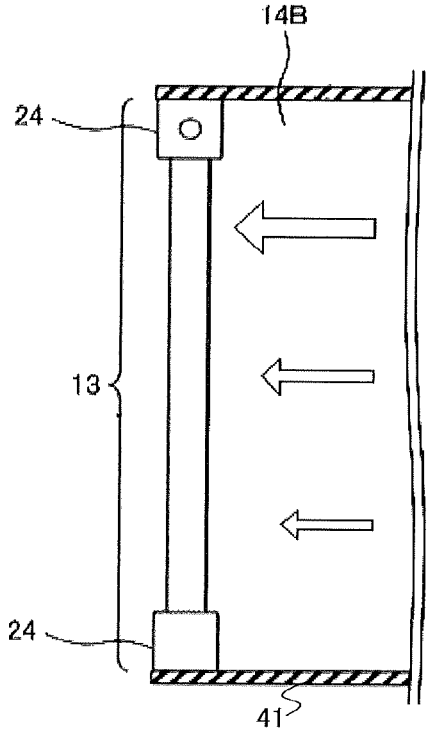
FIG. 11 is a side view for explaining another example of the front heat exchanger of the air-conditioning apparatus according to Embodiment 2 of the present disclosure.
Figure 12:
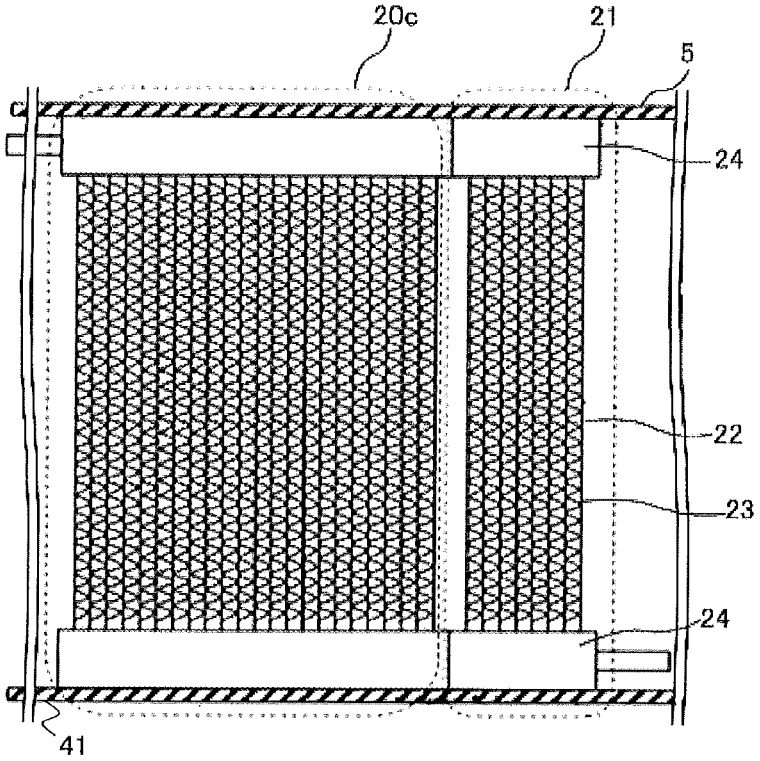
FIG. 12 is a back view of the front heat exchanger as illustrated in FIG. 11.

FIG. 9 is a side view for explaining an example of a front heat exchanger 20*d* of an air-conditioning apparatus according to Embodiment 2 of the present disclosure. FIG. 10 is a back view of the front heat exchanger as illustrated in FIG. 9. FIGS. 11 and 12 are diagrams for explaining another example of the front heat exchanger 20*d* of the air-conditioning apparatus according to Embodiment 2 of the present disclosure. FIGS. 13 to 18 are diagrams for explaining other examples of the front heat exchanger 20*d* of the air-conditioning apparatus according to Embodiment 2 of the present disclosure. Embodiment 2 will be described with reference to FIGS. 9 to 18. FIGS. 9, 11, 13, 15, and 17 are also enlarged side views of the front heat exchanger 20*d*. FIGS. 10, 12, 14, 16, and 18 are also enlarged back views of the front heat exchanger 20*d*.

As illustrated in FIGS. 9 and 10, in the front heat exchanger 20*d* that includes a first heat exchanger 20*c* and a second heat exchanger 21, a plurality of heat transfer tubes 22, a plurality of heat transfer fins 23, and refrigerant distributors 24 are provided. In the plurality of heat transfer tubes 22, flow passages having a circular cross section are provided. The refrigerant distributors 24 distribute refrigerant to the heat transfer tubes 22. The refrigerant distributors 24 are provided at both ends of each of the heat transfer tubes 22. It should be noted that the heat transfer tubes 22 may be flat tubes whose flow passages have an elongated cross section as described above. The first heat exchanger 20*c* and the second heat exchanger 21 may be separate heat exchangers or may be a single heat exchanger that shares the heat transfer fin 23 as illustrated in FIG. 6.

In Embodiment 2, the plurality of heat transfer tubes 22 included in the front heat exchanger 20*d* are provided perpendicular to a first partition plate 41 of a housing 5. This means that the flow direction of refrigerant that flows through the heat transfer tubes 22 are perpendicular to the first partition plate 41. Therefore, in the case where the housing 5 is set such that the first partition plate 41 is parallel with the ground, the refrigerant flows through the heat transfer tubes 22 in a direction perpendicular to the ground.

As illustrated in FIGS. 9 and 10, it is appropriate that the second heat exchanger 21 is provided above the first heat exchanger 20*c*. Because of this configuration, at the second heat exchanger 21, air flows at a higher speed than at the first heat exchanger 20*c*, and liquid refrigerant can be efficiently subcooled. FIGS. 9 and 10 illustrate an example in which one of the refrigerant distributors 24 is provided between the first heat exchanger 20*c* and the second heat exchanger 21. In the configuration as illustrated in FIGS. 9 and 10, the heat transfer fins 23 cannot be shared between the first heat exchanger 20*c* and the second heat exchanger 21. Therefore, the first heat exchanger 20*c* and the second heat exchanger 21 are separately provided on a lower side and an upper side, respectively, with the refrigerant distributor 24 located between the first heat exchanger 20*c* and the second heat exchanger 21.

As illustrated in FIGS. 11 and 12, the second heat exchanger 21 may be provided side by side with the first heat exchanger 20*c* in a horizontal direction. In this case, the second heat exchanger 21 is provided at an end of the front heat exchanger 20*d*; that is, the second heat exchanger 21 is provided on an uppermost stream side of the front heat exchanger 20*d*. Therefore, when the second heat exchanger 21 operates as an evaporator, condensed water generated on a surface of the second heat exchanger 21 efficiently flows away from the second heat exchanger 21. It is therefore possible to prevent an increase in the flow loss of air, and improve the performance during a low-temperature operation.

Figure 13:
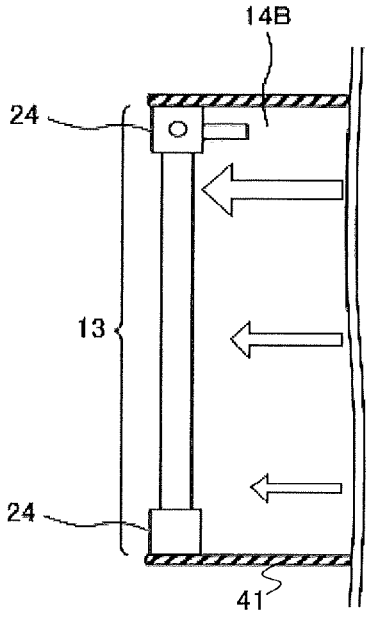
FIG. 13 is a side view for explaining still another example of the front heat exchanger of the air-conditioning apparatus according to Embodiment 2 of the present disclosure.
Figure 14:
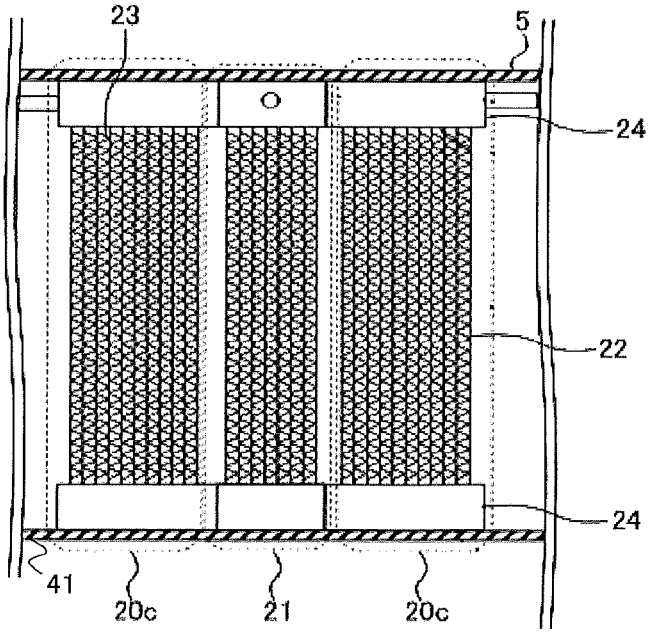
FIG. 14 is a back view of the front heat exchanger as illustrated in FIG. 13.

As illustrated in FIGS. 13 and 14, the second heat exchanger 21 may be provided between first heat exchangers 20*c*. In this case, refrigerant that has passed through the second heat exchanger 21 branches into two refrigerants, which flow through the first heat exchangers 20*c* that are located on left and right sides. As a result, the refrigerant can be more evenly distributed to the plurality of heat transfer tubes 22, thereby improving the heat exchange performance.

Figure 15:
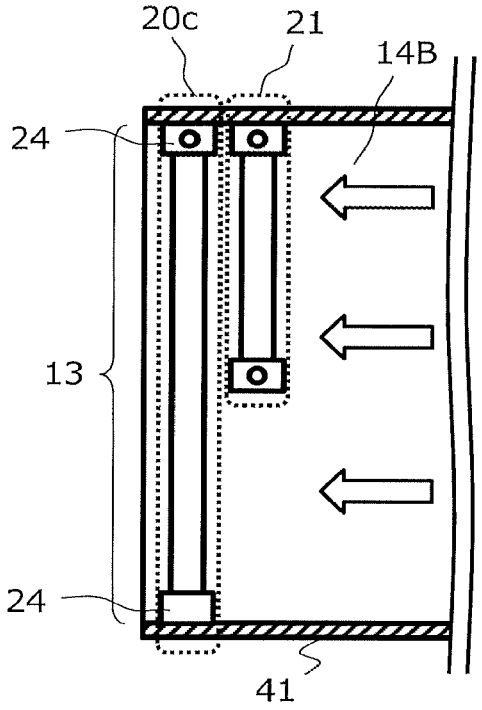
FIG. 15 is a side view for explaining a further example of the front heat exchanger of the air-conditioning apparatus according to Embodiment 2 of the present disclosure.
Figure 16:
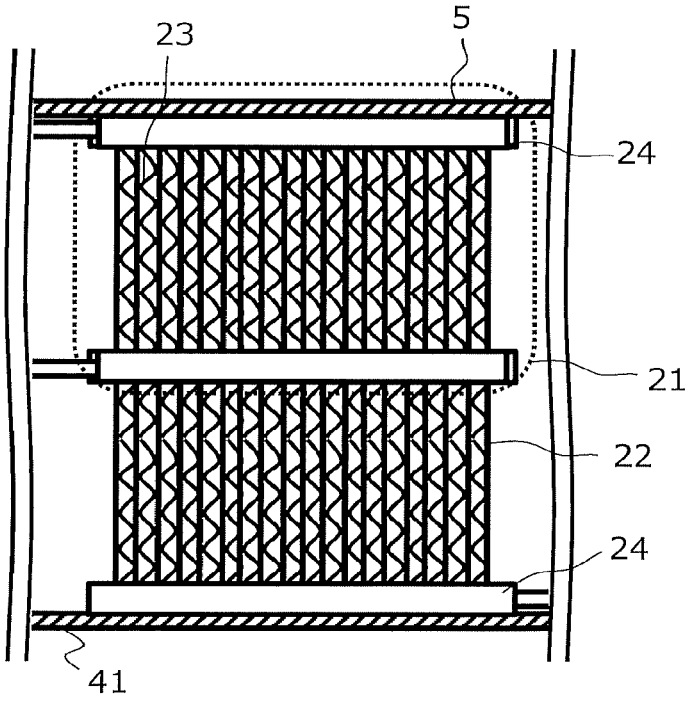
FIG. 16 is a back view of the front heat exchanger as illustrated in FIG. 15.

As illustrated in FIGS. 15 and 16, the second heat exchanger 21 may be provided windward of the first heat exchanger 20*c* and separate from the first heat exchanger 20*c*. In this case, the second heat exchanger 21 and the first heat exchanger 20*c* do not transfer heat to each other, and can thus more efficiently subcool liquid refrigerant. Also, in this case, it is appropriate that the second heat exchanger 21 is provided in contact with an upper side of a blowout air passage 14B. Because of this configuration, a front surface area of the front heat exchanger 20*d* can be maximized, thereby improving the heat exchange efficiency. When the second heat exchanger 21 operates as an evaporator, a larger amount of condensed water is generated on a surface of the second heat exchanger 21 than on the first heat exchanger 20*c*. However, since a component that hinders drainage of water is not present below the second heat exchanger 21, the condensed water can be efficiently drained, and it is possible to prevent an increase in the flow loss of air. In addition, since the temperature difference between the refrigerant and air is greater, the refrigerant can be more efficiently subcooled. Furthermore, since the variation between the amount of air that passes through the front heat exchanger 20*d* at different positions in the height direction of the front heat exchanger 20*d* can be reduced, the heat exchange efficiency can be improved.

In Embodiment 2, a center of a fan 92 in the height direction may be displaced upwards or downwards from a center of the front heat exchanger 20*d* in the height direction. For example, in the case where the center of the fan 92 is displaced upwards from the center of the front heat exchanger 20*d* in the height direction, it is preferable that the second heat exchanger 21 be provided as illustrated in FIGS. 15 and 16. The second heat exchanger 21 is provided closer to the fan 92 than the first heat exchanger 20*c* and side by side with the first heat exchanger 20*c* in a direction in which the fan 92 blows air. Even in this configuration, the heat exchange efficiency can be improved as described above.

Figure 17:
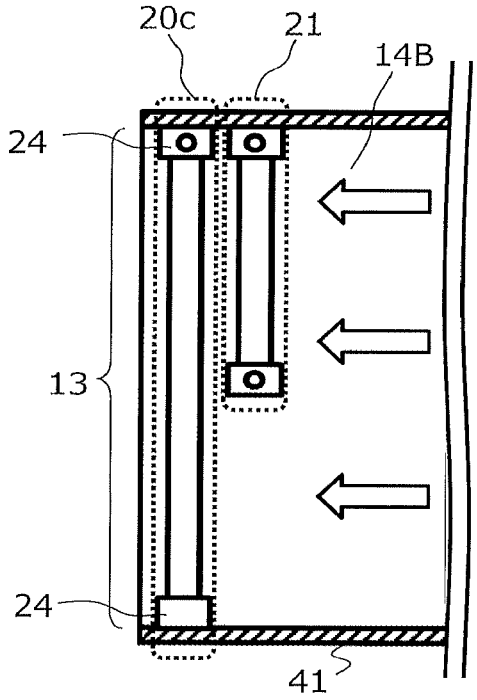
FIG. 17 is a side view for explaining a still further example of the front heat exchanger of the air-conditioning apparatus according to Embodiment 2 of the present disclosure.
Figure 18:
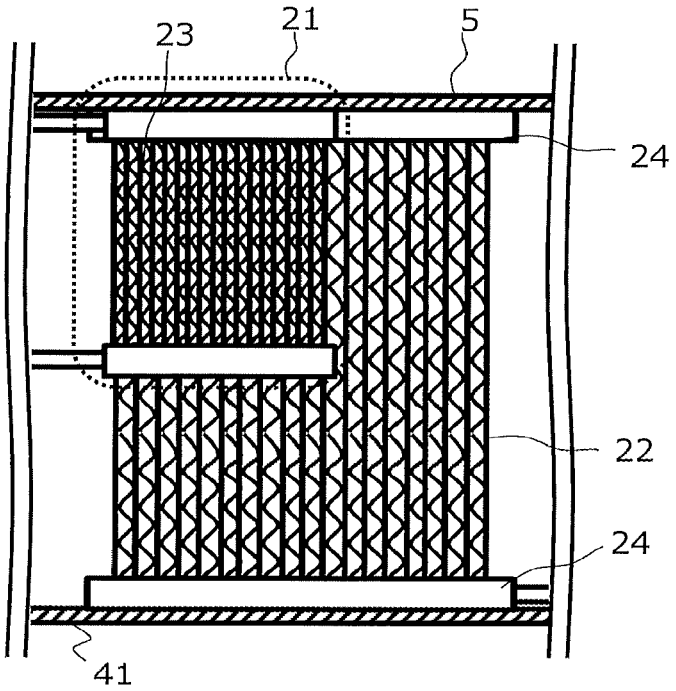
FIG. 18 is a back view of the front heat exchanger as illustrated in FIG. 17.

As illustrated in FIGS. 17 and 18, the second heat exchanger 21 may be provided windward of the first heat exchanger 20*c* and separate from the first heat exchanger 20*c*, and the height of the second heat exchanger 21 may be smaller than that of the first heat exchanger 20*c*. To be more specific, the length of the second heat exchanger 21 in the height direction is smaller than that of the first heat exchanger 20*c* as illustrated in FIG. 17, and the length of the second heat exchanger 21 in a lateral direction of the second heat exchanger 21 is smaller than that of the first heat exchanger 20*c* as illustrated in FIG. 18. In the case where a rotational speed of the fan 92 in the circumferential direction is resolved into a component in a direction perpendicular to the air outlet 13 and a component in a direction parallel to the air outlet 13, the second heat exchanger 21 is provided on a line extended from the air outlet 13 in a direction in which the component in the direction perpendicular to the air outlet 13 is maximized. In this case, the second heat exchanger can be provided at a position where the amount of air is large. Therefore, in addition to the advantage obtained by the configuration as illustrated in FIGS. 15 and 16, it is possible to obtain an advantage which the liquid refrigerant can be efficiently subcooled.

Embodiment 3

Embodiment 3 of the present disclosure will be described below. In Embodiment 3, components that are the same as or equivalent to those of Embodiments 1 and/or 2 will be denoted by the same reference signs, and of descriptions of the components, descriptions that are the same as those regarding any of Embodiments 1 and/or 2 will not be repeated.

Figure 19:
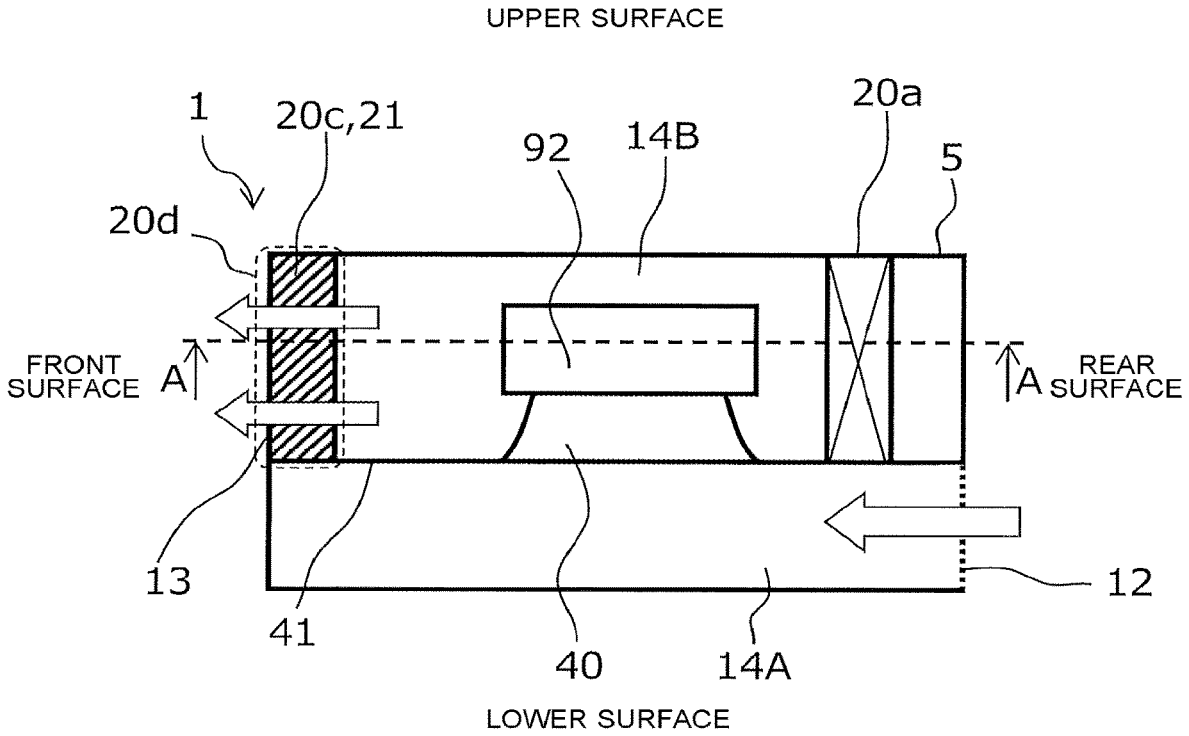
FIG. 19 is a side view schematically illustrating a condensation unit of an air-conditioning apparatus according to Embodiment 3 of the present disclosure.
Figure 20:
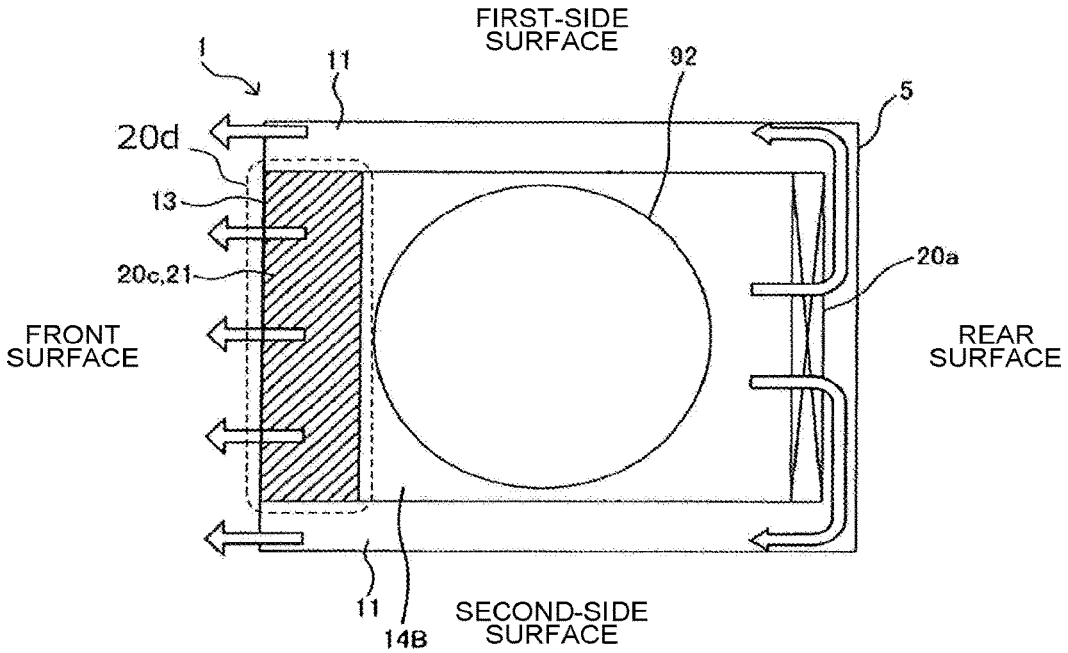
FIG. 20 is a cross-sectional view schematically illustrating an example of a section taken along line A-A in FIG. 19.

FIG. 19 is a side view schematically illustrating a condensation unit 1 of an air-conditioning apparatus according to Embodiment 3 of the present disclosure. FIG. 20 is a cross-sectional view schematically illustrating an example of a cross section taken along line A-A in FIG. 19. Embodiment 3 will be described with reference to FIGS. 19 and 20. In FIGS. 19 and 20, the flows of air are indicated by arrows.

As illustrated in FIG. 19, in Embodiment 3, two side heat exchangers 20*b* provided to face the first side surface and the second side surface of the condensation unit 1 are omitted. In this regard, Embodiment 3 is different from Embodiments 1 and 2. To be more specific, in Embodiment 3, a first heat exchanger 20*c* and a second heat exchanger 21 are disposed close to a fan 92 in such a way as to face an air outlet 13, and a rear heat exchanger 20*a* is provided at a position leading to an inlet of a side air passage 11.

Because of the above configuration, space can be ensured beside the side surfaces of the condensation unit 1. In the air-conditioning apparatus according to the Embodiment 3, it is therefore possible to increase the diameter of the fan 92, reduce the pressure loss of air that passes through the heat exchangers, and reduce the amount of refrigerant. As a result, the performance of the whole system is improved.

Embodiment 4

Embodiment 4 of the present disclosure will be described below. In Embodiment 3, components that are the same as or equivalent to those of any of Embodiments 1 to 3 will be denoted by the same reference signs, and of descriptions of the components, descriptions that are the same as those regarding any of Embodiments 1 to 3 will not be repeated.

Figure 21:
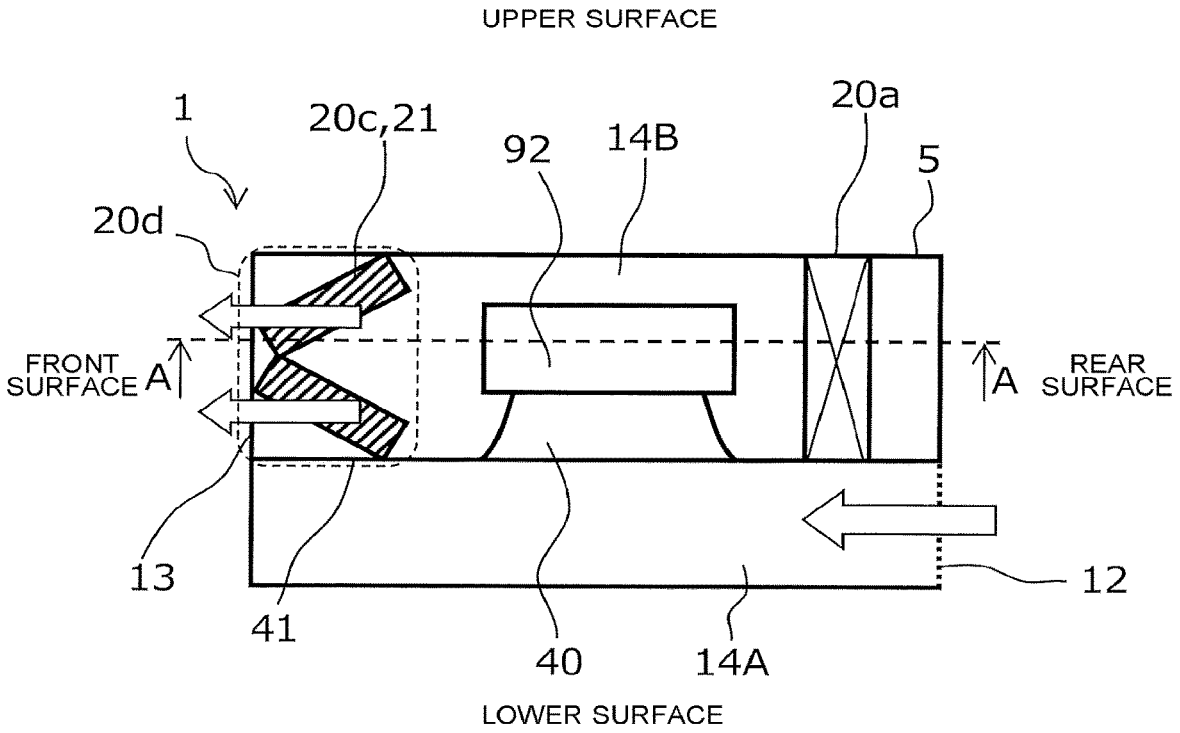
FIG. 21 is a side view schematically illustrating a condensation unit of an air-conditioning apparatus according to Embodiment 4 of the present disclosure.
Figure 22:
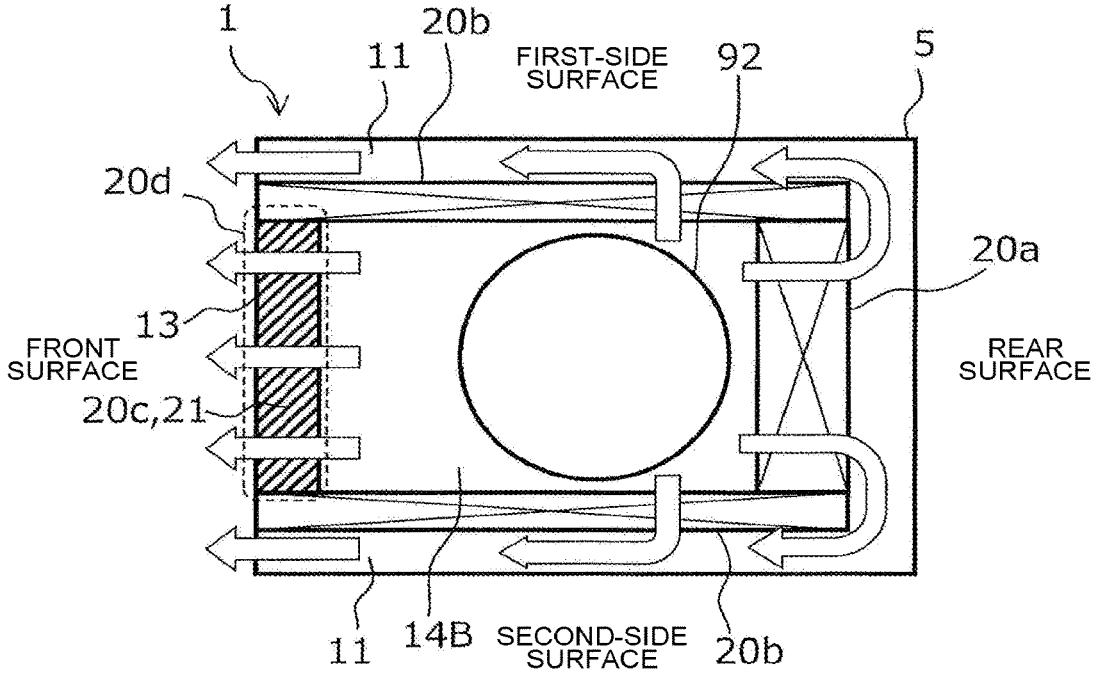
FIG. 22 is a cross-sectional view schematically illustrating an example of a cross section taken line A-A in FIG. 21.

FIG. 21 is a side view schematically illustrating a condensation unit 1 of an air-conditioning apparatus according to Embodiment 4 of the present disclosure. FIG. 22 is a cross-sectional view schematically illustrating an example of a cross section taken along line A-A in FIG. 21. Embodiment 4 will be described with reference to FIGS. 21 and 22. In FIGS. 21 and 22, the flows of air are indicated by arrows.

As illustrated in FIGS. 21, in Embodiment 4, a front heat exchanger 20*d* that includes a first heat exchanger 20*c* and a second heat exchanger 21 is divided into two heat exchange blocks, which are arranged to be V-shaped as viewed in sectional side view. In this regard, Embodiment 4 is different from Embodiments 1 to 3. To be more specific, an upper one of the heat exchange blocks of the front heat exchanger 20*d* is inclined upwards from an air-outlet side where an air outlet 13 is located, toward a fan side where a fan 92 is located, and a lower one of the heat exchange blocks of the front heat exchanger 20*d* is inclined downwards from the air-outlet side toward the fan side. Therefore, the front heat exchanger 20*d* is formed in the V-shape in cross-sectional view.

In such a manner, the first heat exchanger 20*c* and the second heat exchanger 21 that are included in the front heat exchanger 20*d* are provided in such a way as to face the air outlet 13, and are arranged to be V-shaped as viewed in sectional side view. Therefore, in the air-conditioning apparatus according to Embodiment 4, the front heat exchanger 20*d* is provided in such a way to be V-shaped as viewed in sectional side view, whereby the number of stages of the first heat exchanger 20*c* and the second heat exchanger 21 can be increased, and as a result, the performance of the whole system can be improved.

Regarding Embodiment 4, although it is described above by way of example that the front heat exchanger 20*d*, side heat exchangers 20*b*, and a rear heat exchanger 20*a* are provided in such a manner as to surround the fan 92, the number of surfaces where the heat exchangers are provided is not limited to a specific number. For example, the side heat exchangers 20*b* may be omitted as described regarding Embodiment 3. Also, regarding Embodiment 4, although it is described above 1 that the front heat exchanger 20*d* is provided in such a manner to be V-shaped as viewed in sectional side view, the side heat exchangers 20*b* and/or the rear heat exchanger 20*a* may be provided in such a manner as to be V-shaped as viewed in sectional side view.

Next, the position, configuration, and structure of the second heat exchanger 21 in the case where the front heat exchanger 20*d* is provided in such a manner as to be V-shaped as viewed in sectional side view will be described in detail.

Figure 23:
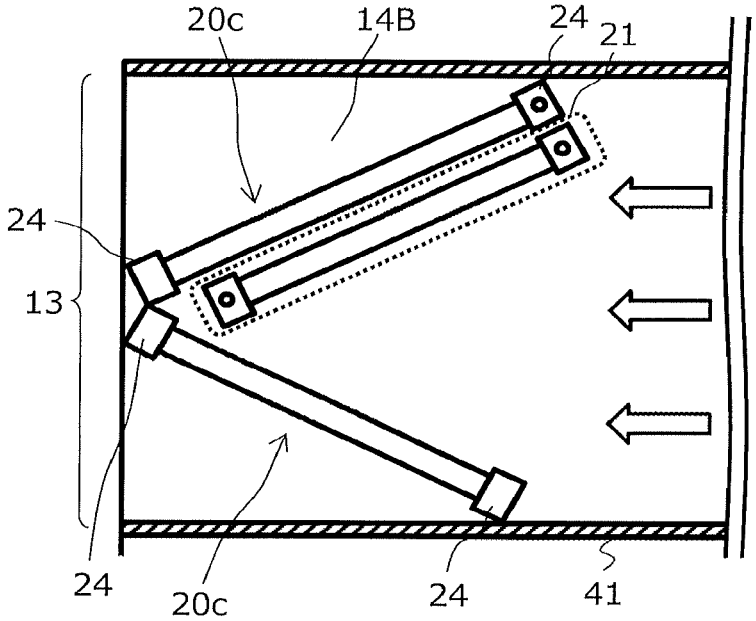
FIG. 23 is a side view schematically illustrating another condensation unit of the air-conditioning apparatus according to Embodiment 4 of the present disclosure.
Figure 24:
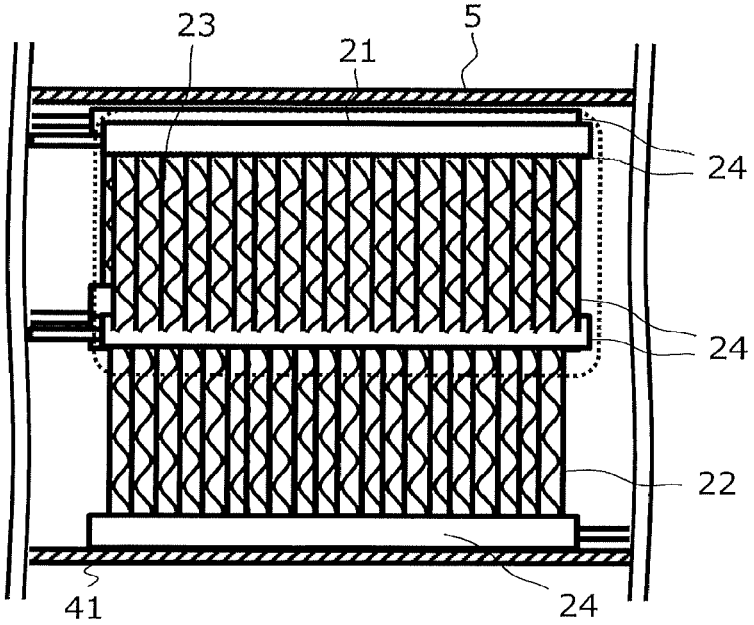
FIG. 24 is a back view schematically illustrating the condensation unit as illustrated in FIG. 23.

FIG. 23 is a side view schematically illustrating another condensation unit of an air-conditioning apparatus according to Embodiment 4 of the present disclosure. FIG. 24 is a back view schematically illustrating the condensation unit as illustrated in FIG. 23. In the case where as illustrated in FIGS. 23 and 24, the second heat exchanger 21 is provided on an upper one of the first heat exchangers 20*c* that are arranged to be V-shaped as viewed in sectional side view, that is, one of the first heat exchanger 20*c* that is located at an upper stage and on a windward side relative to the other, the number of stages of the second heat exchanger 21 can be increased. Furthermore, the variation between the flow amounts of air that pass through the front heat exchanger 20*d* at different positions is reduced to a smaller value. It is therefore possible to improve the performance of the whole system. Furthermore, when the second heat exchanger 21 operates as an evaporator, a larger amount of condensed water is generated on a surface of the second heat exchanger 21 than on the first heat exchanger 20*c*. However, since a component that hinders drainage of water is not provided below the second heat exchanger 21, the condensed water can be efficiently drained, and it is possible to prevent an increase in the flow loss of air. In addition, since the variation between the amounts of air that passes through the front heat exchanger 20*d* at the different positions in the height direction of the front heat exchanger 20*d* can be reduced, the heat exchange efficiency can be improved.

Figure 25:
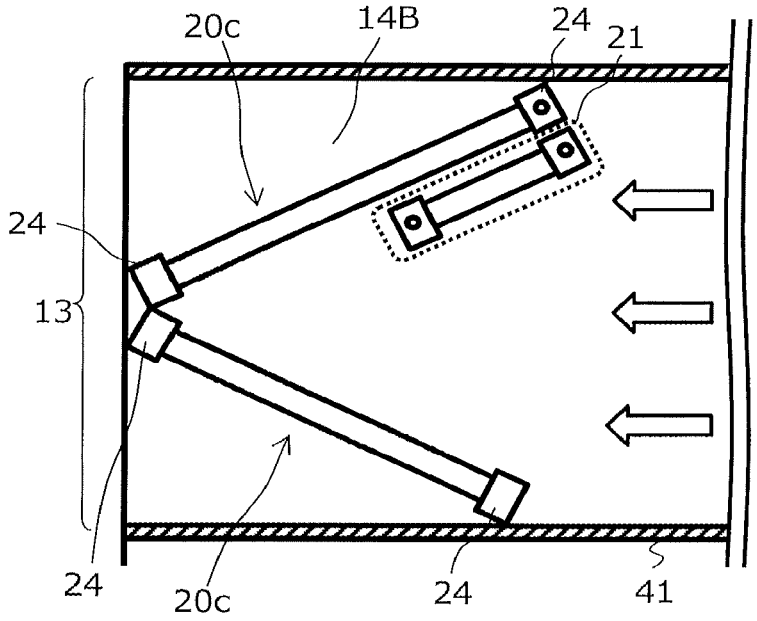
FIG. 25 is a side view schematically illustrating still another condensation unit of the air-conditioning apparatus according to Embodiment 4 of the present disclosure.
Figure 26:
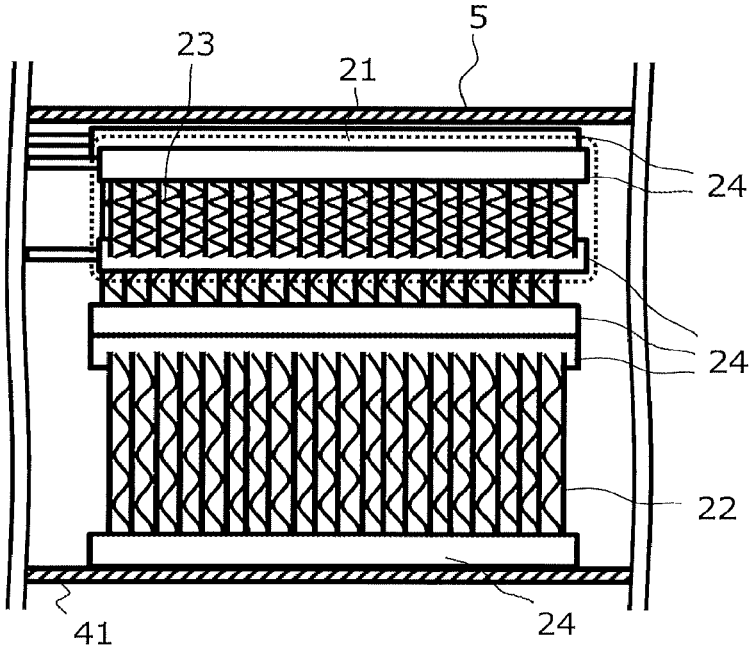
FIG. 26 is a back view schematically illustrating the condensation unit as illustrated in FIG. 25.
Figure 27:
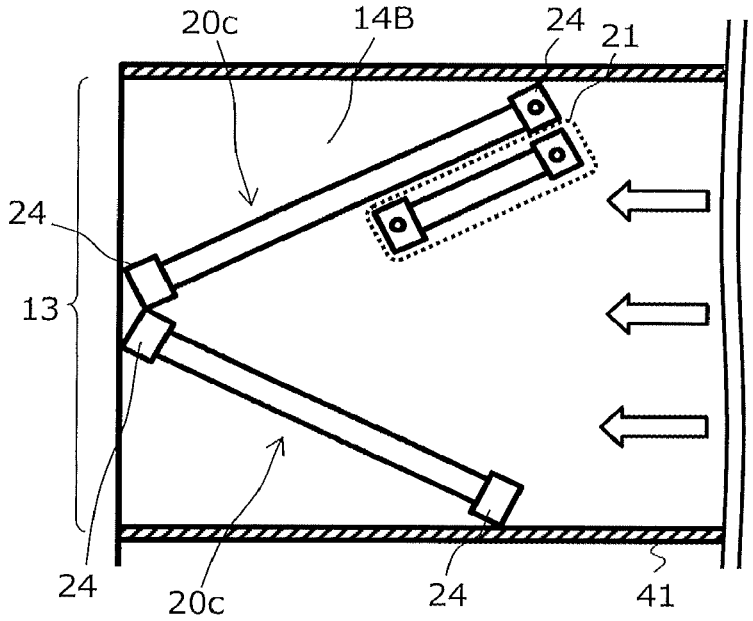
FIG. 27 is a side view schematically illustrating a further condensation unit of the air-conditioning apparatus according to Embodiment 4 of the present disclosure.
Figure 28:
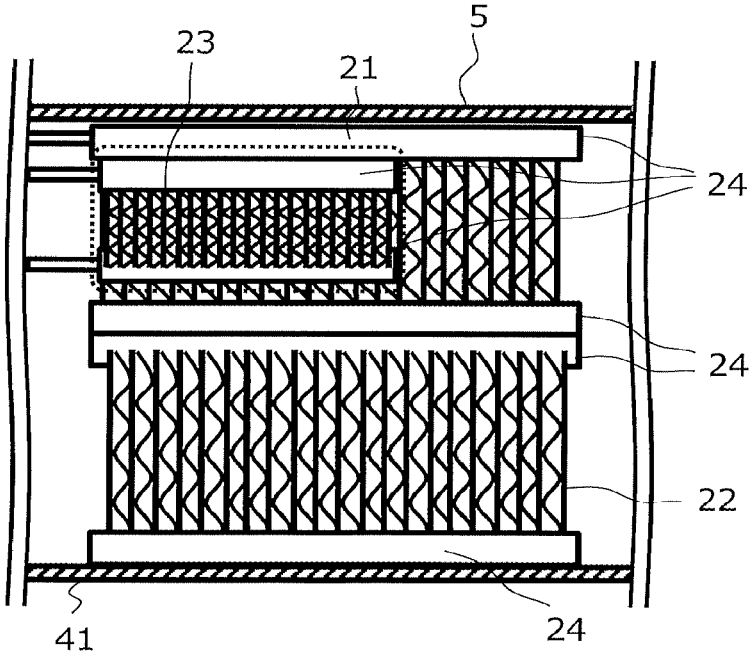
FIG. 28 is a back view schematically illustrating the condensation unit as illustrated in FIG. 27.

FIG. 25 is a side view schematically illustrating still another condensation unit of the air-conditioning apparatus according to Embodiment 4 of the present disclosure. FIG. 26 is a back view schematically illustrating the condensation unit as illustrated in FIG. 25. FIG. 27 is a side view schematically illustrating a further condensation unit of the air-conditioning apparatus according to Embodiment 4 of the present disclosure. FIG. 28 is a back view schematically illustrating the condensation unit as illustrated in FIG. 27. The height of the second heat exchanger 21 may be smaller than that of each of the first heat exchangers 20*c* as illustrated in FIGS. 25 and 26. Furthermore, the height and the width of the second heat exchanger 21 may be smaller than those of each first heat exchanger 20*c* as illustrated in FIGS. 27 and 28. That is, one or both of the height and width of the second heat exchanger 21 may be smaller than that of each first heat exchanger 20*c*. In this case, the variation between the amounts of air that passes through the front heat exchanger 20*d* at the different positions is reduced to a smaller value. As a result, the performance of the whole system can be improved.

Figure 29:
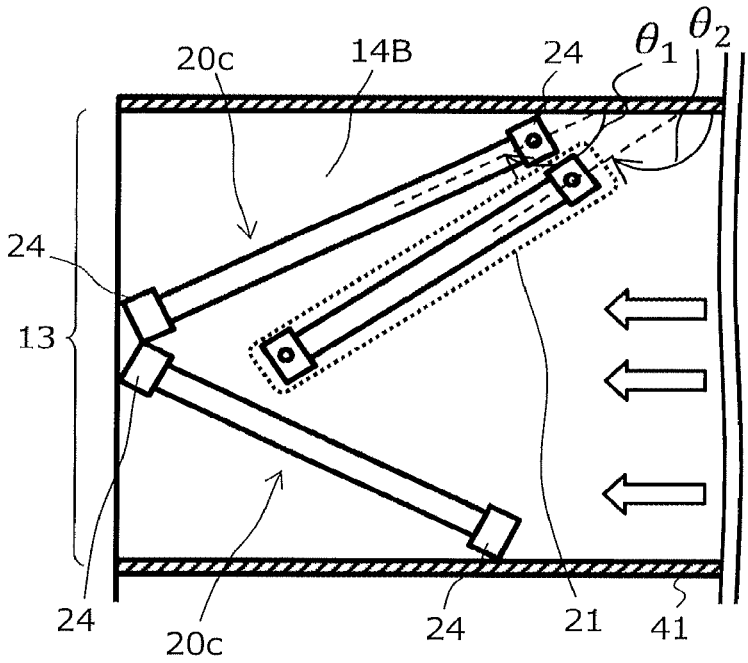
FIG. 29 is a side view schematically illustrating a still further condensation unit of the air-conditioning apparatus according to Embodiment 4 of the present disclosure.
Figure 30:
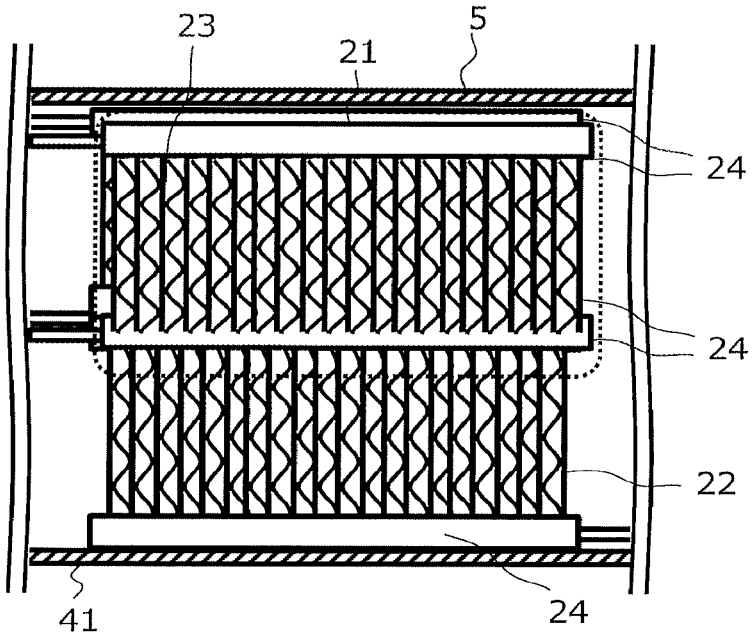
FIG. 30 is a back view schematically illustrating the condensation unit as illustrated in FIG. 29.

FIG. 29 is a side view schematically illustrating a still further condensation unit of the air-conditioning apparatus according to Embodiment 4 of the present disclosure. FIG. 30 is a back view schematically illustrating the condensation unit as illustrated in FIG. 29. Where, as illustrated in FIGS. 29 and 30, θ1 is the angle between the height direction and the horizontal direction of the first heat exchanger 20*c*, and θ2 is the angle between the height direction and the horizontal direction of the second heat exchanger 21, the first heat exchanger 20*c* and the second heat exchanger 21 may be provided to satisfy the relationship "θ1≥θ2". In the relationship "θ1≥θ2", the distance between the first heat exchanger 20*c* and the second heat exchanger 21 decreases in a direction toward the fan 92. Because of this configuration, the pressure loss of air that passes through the second heat exchanger 21 and the first heat exchanger 20*c* can be reduced, and the performance of the whole system can thus be improved.

Embodiment 5

With respect to Embodiment 5, components that are the same as or equivalent to those of any of Embodiments 1 to 4 will be denoted by the same reference signs, and of descriptions of the components, descriptions that are the same as those regarding any of Embodiments 1 to 4 will not be repeated.

Figure 31:
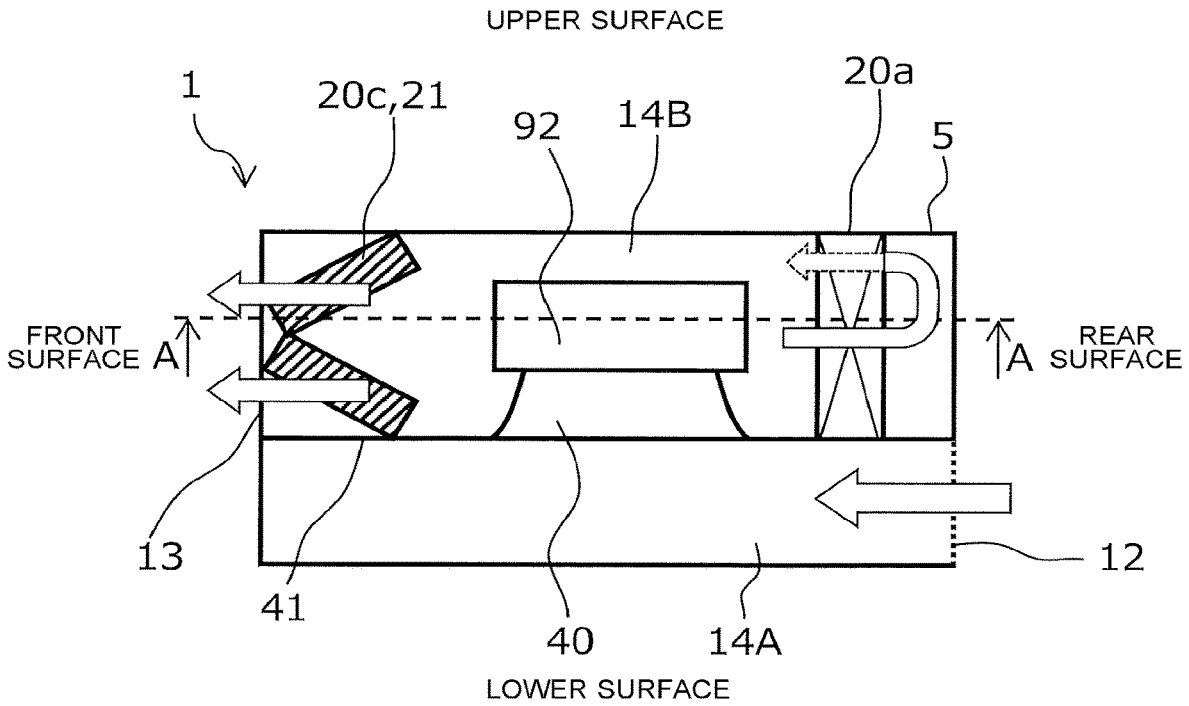
FIG. 31 is a side view schematically illustrating a condensation unit of an air-conditioning apparatus according to Embodiment 5 of the present disclosure.
Figure 32:
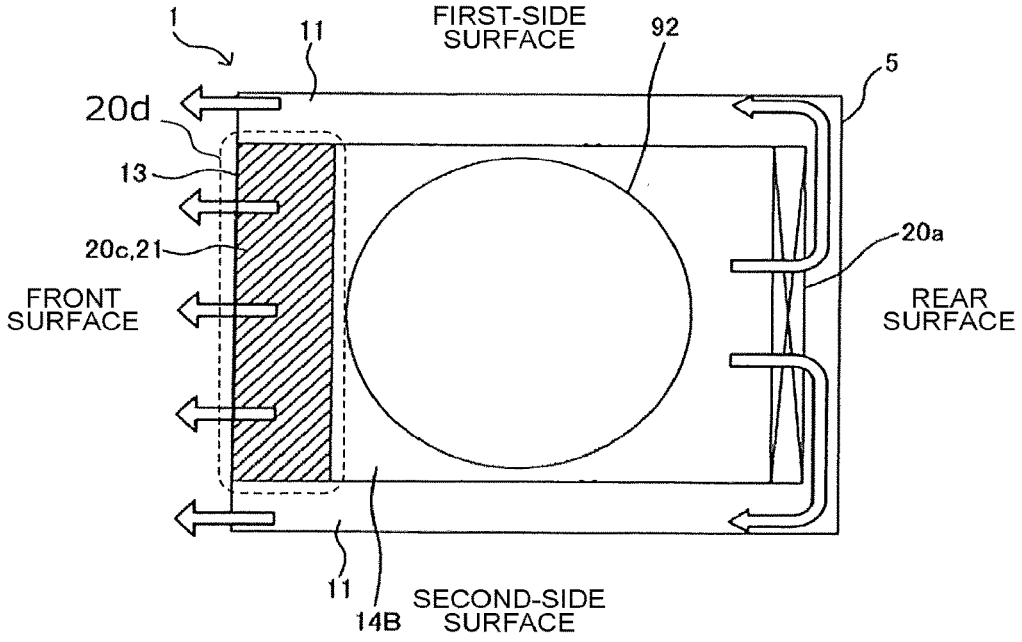
FIG. 32 is a cross-sectional view schematically illustrating an example of a cross section taken along line A-A in FIG. 31.

FIG. 31 is a side view schematically illustrating a condensation unit 1 of an air-conditioning apparatus according to Embodiment 5 of the present disclosure. FIG. 32 is a cross-sectional view schematically illustrating an example of a cross section taken along line A-A in FIG. 31. Embodiment 5 will be described below with reference to FIGS. 31 and 32. In FIGS. 31 and 32, the flows of air are indicated by arrows.

As illustrated in FIG. 32, in Embodiment 5, two side heat exchangers 20*b* provided to face a first side surface and a second side surface of the condensation unit 1 in Embodiment 4 are omitted. In this regard, Embodiment 5 is different from Embodiment 4. To be more specific, in Embodiment 5, a first heat exchanger 20*c* and a second heat exchanger 21 are provided in such a manner as to face an air outlet 13 and also to be V-shaped as viewed in sectional side view, and a rear heat exchanger 20*a* is provided at a position leading to an inlet of a side air passage 11, as a result of which the first heat exchanger 20*c*, the second heat exchanger 21, and the rear heat exchanger 20*a* surround the fan 92.

Because of the above configuration, space can be ensured beside the side surfaces of the condensation unit 1. Therefore, in the air-conditioning apparatus according to the Embodiment 5, it is possible to increase the diameter of the fan 92, reduce the pressure loss of air that passes through the heat exchangers, and reduce the amount of refrigerant. As a result, the performance of the whole system is improved.

Embodiment 5 is the same as Embodiment 4 except that in Embodiment 5, the two side heat exchangers 20*b* are not provided. Furthermore, although regarding Embodiment 5, it is described above by way of example how the front heat exchanger 20*d* is provided, the rear heat exchanger 20*a* may be provided in such a manner as to be V-shaped as viewed in sectional side view.

Embodiment 6

Embodiment 6 of the present disclosure will be described below. With respect to Embodiment 6, components that are the same as or equivalent to those of any of Embodiments 1 to 5 will be denoted by the same reference signs, and of descriptions of the components, descriptions that are the same as those regarding any of Embodiments 1 to 5 will not be repeated.

Figure 33:
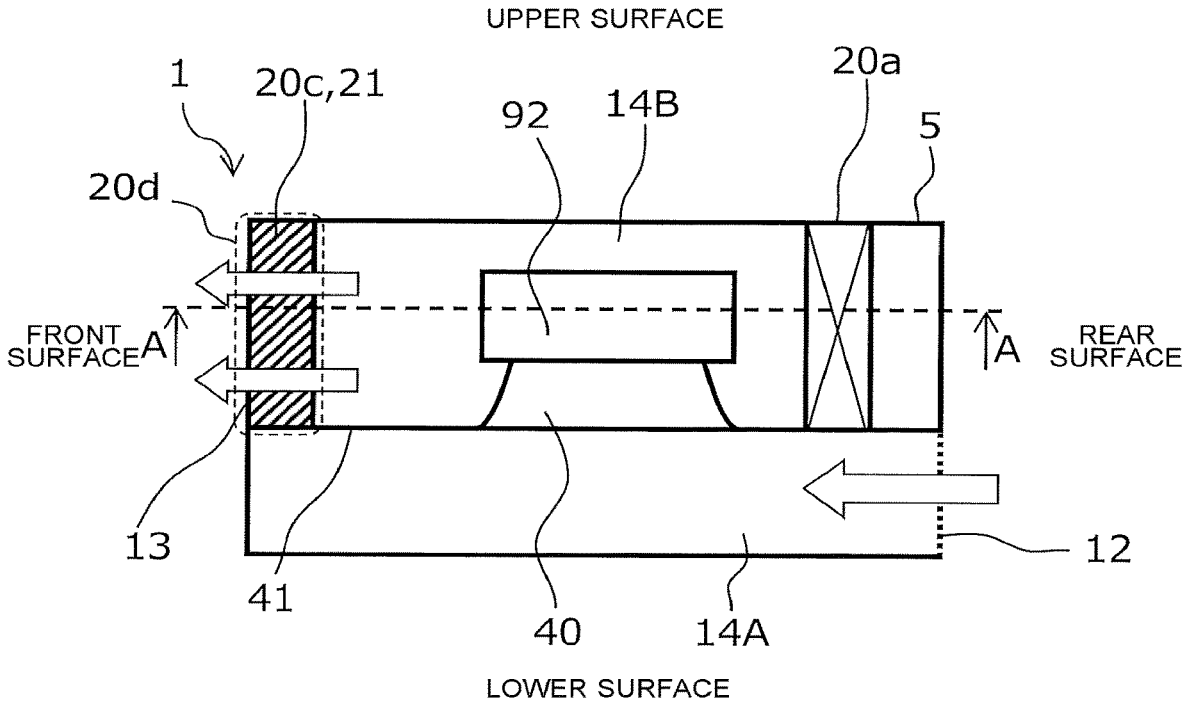
FIG. 33 is a side view schematically illustrating a condensation unit of an air-conditioning apparatus according to Embodiment 6 of the present disclosure.
Figure 34:
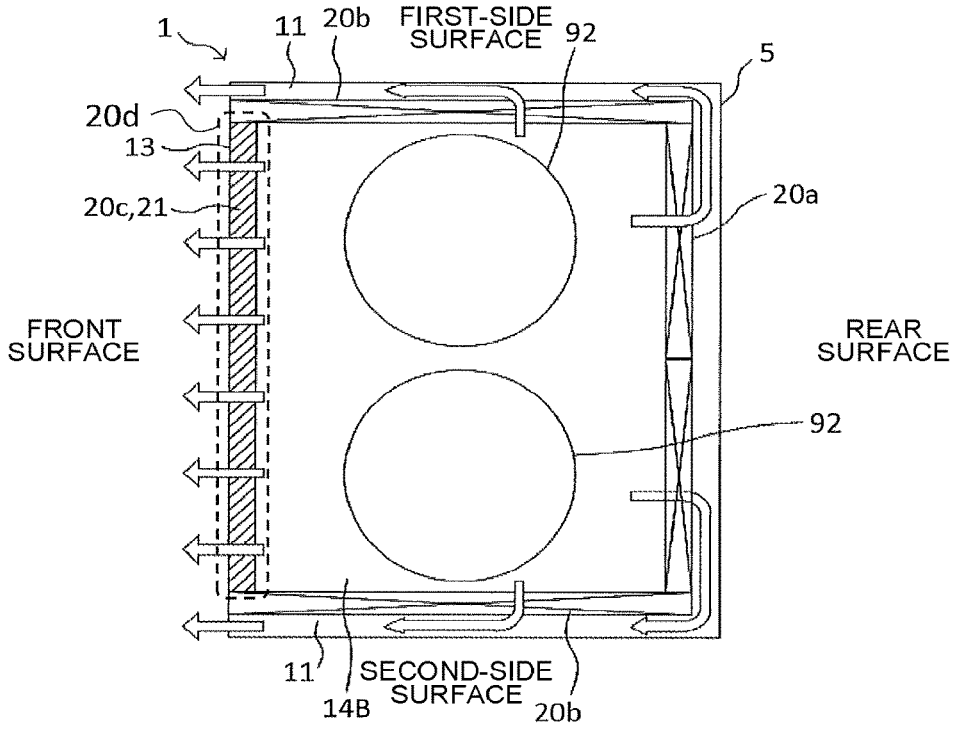
FIG. 34 is a cross-sectional view schematically illustrating an example of a cross section taken along line A-A in FIG. 33.

FIG. 33 is a side view schematically illustrating a condensation unit 1 of an air-conditioning apparatus according to Embodiment 6 of the present disclosure. FIG. 34 is a cross-sectional view schematically illustrating an example of a cross section taken along line A-A in FIG. 33. Embodiment 6 will be described with reference to FIGS. 33 and 34. In FIGS. 33 and 34, the flows of air are indicated by arrows.

As illustrated in FIG. 34, in Embodiment 6, a plurality of fans 92 are provided. In this regard, Embodiment 6 is different from Embodiments 1 to 5. To be more specific, in Embodiment 6, two fans 92 are arranged in a direction along the long sides, that is, the lateral direction of a housing 5 that is rectangular as viewed in plan view. More specifically, a rear heat exchanger 20*a*, side heat exchangers 20*b*, a first heat exchanger 20*c*, and a second heat exchanger 21 are provided in such a manner as to face four surfaces of the housing 5 and surround the two fans 92.

Because of this configuration, in the air-conditioning apparatus according to Embodiment 6, the total height of the rear heat exchanger 20*a*, the side heat exchangers 20*b*, the first heat exchanger 20*c*, and the second heat exchanger 21 is increased, and the heat exchange performance is increased. Furthermore, in the air-conditioning apparatus according to Embodiment 6, the pressure loss of air that passes through the rear heat exchanger 20*a*, the side heat exchangers 20*b*, the first heat exchanger 20*c*, and the second heat exchanger 21 can be reduced, and as a result, the performance of the whole system can be improved.

Embodiment 7

With respect to Embodiment 7, components that are the same as or equivalent to those of any of Embodiments 1 to 6 will be denoted by the same reference signs, and of descriptions of the components, descriptions that are the same as those regarding any of Embodiments 1 to 6 will not be repeated.

Figure 35:
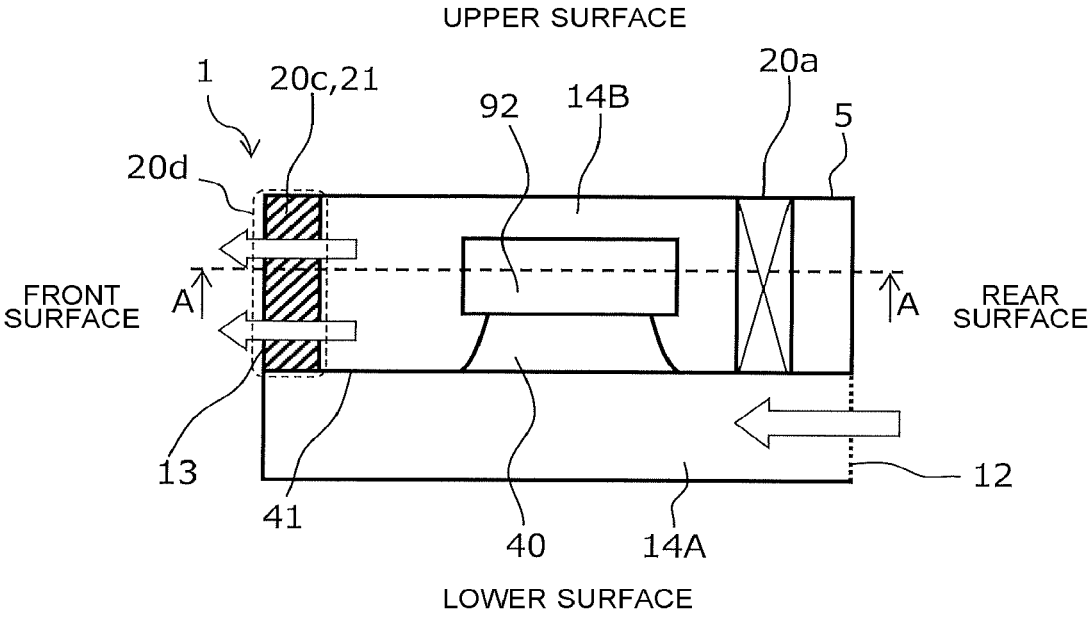
FIG. 35 is a side view schematically illustrating a condensation unit of an air-conditioning apparatus according to Embodiment 7 of the present disclosure.
Figure 36:
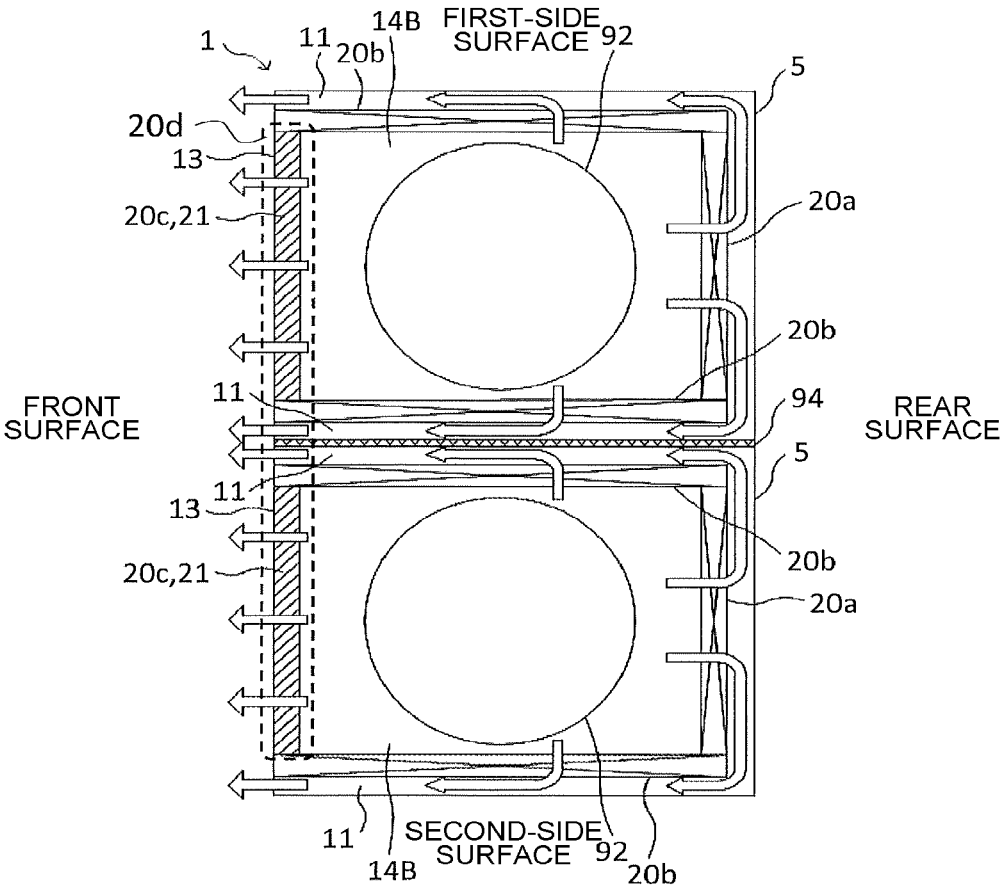
FIG. 36 is a cross-sectional view schematically illustrating an example of a cross section taken along line A-A in FIG. 35.

FIG. 35 is a side view schematically illustrating a condensation unit 1 of an air-conditioning apparatus according to Embodiment 7 of the present disclosure. FIG. 36 is a cross-sectional view schematically illustrating an example of a cross section taken along line A-A in FIG. 35. Embodiment 7 will be described below with reference to FIGS. 35 and 36. In FIGS. 35 and 36, the flows of air are indicated by arrows.

In Embodiment 7, as illustrated in FIG. 36, a plurality of fans 92 are provided, and a second partition plate 94 is provided to partition space in which the fans 92 are provided. In this regard, Embodiment 7 is different from Embodiment 6. To be more specific, in Embodiment 7, two fans 92 are arranged in the lateral direction of a housing 5 as in Embodiment 6, and in addition, the second partition plate 94 is provided between the two fans 92, and two side heat exchangers 20*b* and two side air passages 11 are provided for the fans 92; that is, for the fans 92, respective heat exchangers 20*b* and respective side air passages 11 are provided. Because of provision of the second partition plate 94 between the fans 92, in spaces into which the above space is partitioned by the second partition plate 94, respective side air passages 11 are provided.

Because of the above configuration, in the air-conditioning apparatus according to Embodiment 7, the total height of a rear heat exchanger 20*a*, the side heat exchangers 20*b*, a first heat exchanger 20*c*, and a second heat exchanger 21 increases, and heat exchange performance are increased. Furthermore, in the air-conditioning apparatus according to Embodiment 7, the pressure loss of air that passes through the rear heat exchanger 20*a*, the side heat exchangers 20*b*, the first heat exchanger 20*c*, and the second heat exchanger 21 can be reduced. As a result, the performance of the whole system can be improved.

Embodiment 8

With respect to Embodiment 8, components that are the same as or equivalent to those of any of Embodiments 1 to 7 will be denoted by the same reference signs, and of descriptions of the components, descriptions that are the same as those regarding any of Embodiments 1 to 4 will not be repeated.

Figure 37:
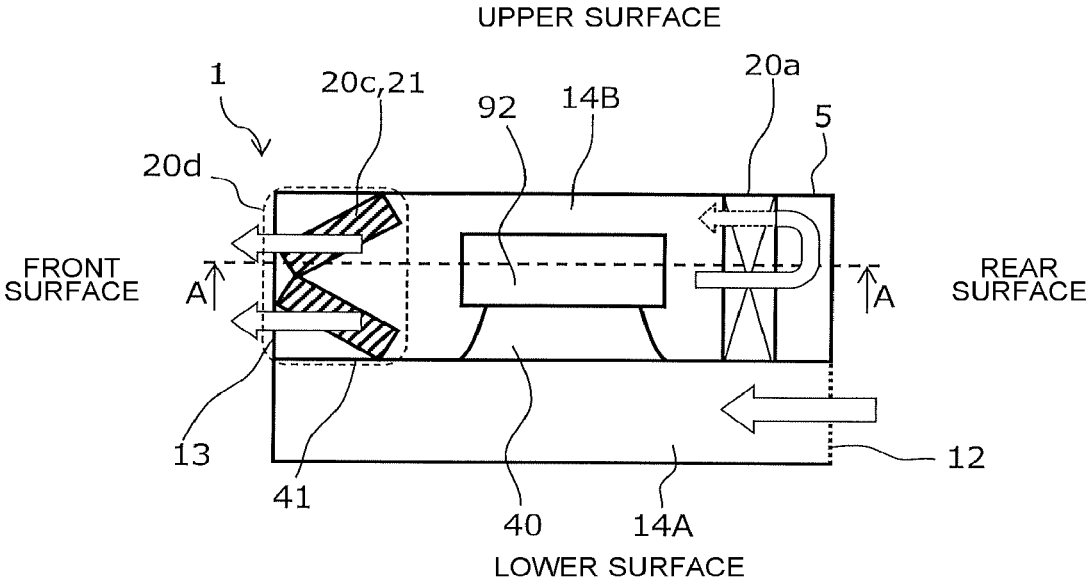
FIG. 37 is a side view schematically illustrating a condensation unit of an air-conditioning apparatus according to Embodiment 8 of the present disclosure.
Figure 38:
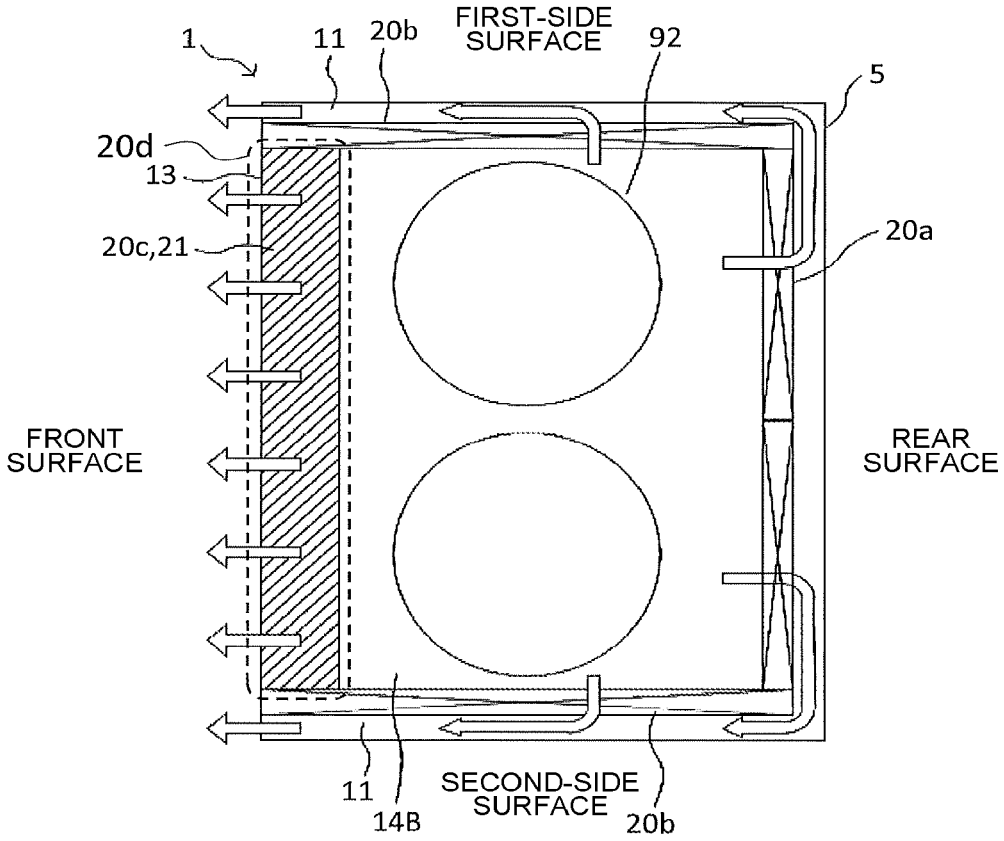
FIG. 38 is a cross-sectional view schematically illustrating an example of a cross section taken along line A-A in FIG. 37.

FIG. 37 is a side view schematically illustrating a condensation unit 1 of an air-conditioning apparatus according to Embodiment 8 of the present disclosure. FIG. 38 is a cross-sectional view schematically illustrating an example of a cross section taken along line A-A in FIG. 37. Embodiment 8 will be described with reference to FIGS. 37 and 38. In FIGS. 37 and 38, the flows of air are indicated by arrows.

In Embodiment 8, as illustrated in FIG. 37, a plurality of fans 92 are provided, and a front heat exchanger 20*d* that includes a first heat exchanger 20*c* and a second heat exchanger 21 is provided in such a manner as to be V-shaped as viewed in sectional side view. That is, the front heat exchanger 20*d* is divided into two heat exchange blocks, which are arranged to be V-shaped in cross-sectional view. To be more specific, an upper one of the heat exchange blocks of the front heat exchanger 20*d* is inclined upwards from an air outlet side where an air outlet 13 is located, toward a fan side where a fan 92 is located, and a lower one of the heat exchange blocks of the front heat exchanger 20*d* is inclined downwards from the air outlet side toward the fan side.

Because of the above configuration, a rear heat exchanger 20*a*, side heat exchangers 20*b*, the first heat exchanger 20*c*, and the second heat exchanger 21 are arranged in such a manner as to surround the two fans 92, and the front heat exchanger 20*d* is provided in such a manner as to face the air outlet 13 and to be V-shaped as viewed in sectional side view. Therefore, in the air-conditioning apparatus according to Embodiment 8, the total height of the rear heat exchanger 20*a*, the side heat exchangers 20*b*, the first heat exchanger 20*c*, and the second heat exchanger 21 is increased, and the heat exchange performance is increased. Furthermore, in the air-conditioning apparatus according to Embodiment 8, the pressure loss of air that passes through the rear heat exchanger 20*a*, the side heat exchangers 20*b*, the first heat exchanger 20*c*, and the second heat exchanger 21 can be reduced. As a result, the performance of the whole system can be improved. Furthermore, since the front heat exchanger 20*d* is provided to be V-shaped in cross-sectional view, the number of stages of the first heat exchanger 20*c* and the second heat exchanger 21 can be increased. As a result, the performance of the whole system can be improved.

Regarding Embodiment 8, it is described above by way of example that the front heat exchanger 20*d*, the side heat exchangers 20*b*, and the rear heat exchanger 20*a* are provided in such a manner as to surround the fans 92, the number of surfaces on which the heat exchangers are provided is not limited to a specific number. For example, the side heat exchangers 20*b* may be omitted as in Embodiment 2. Furthermore, with respect to Embodiment 8, although an example of provision of the front heat exchanger 20*d* is described above, at least one of the rear heat exchanger 20*a* and a side heat exchanger pair, that is, the side heat exchangers 20*b*, may be provided to be V-shaped as viewed in sectional side view.

Embodiment 9

Embodiment 9 of the present disclosure will be described below. With respect to

Embodiment 9, components that are the same as or equivalent to those of any of Embodiments 1 to 8 will be denoted by the same reference signs, and of descriptions of the components, descriptions that are the same as those regarding any of Embodiments 1 to 8 will not be repeated.

Figure 39:
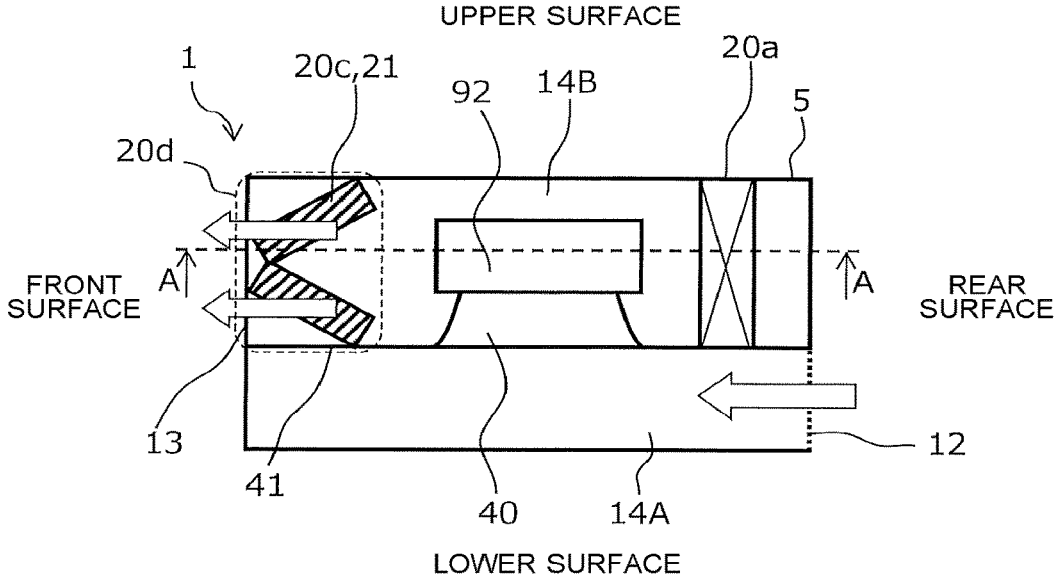
FIG. 39 is a side view schematically illustrating a condensation unit of an air-conditioning apparatus according to Embodiment 9 of the present disclosure.
Figure 40:
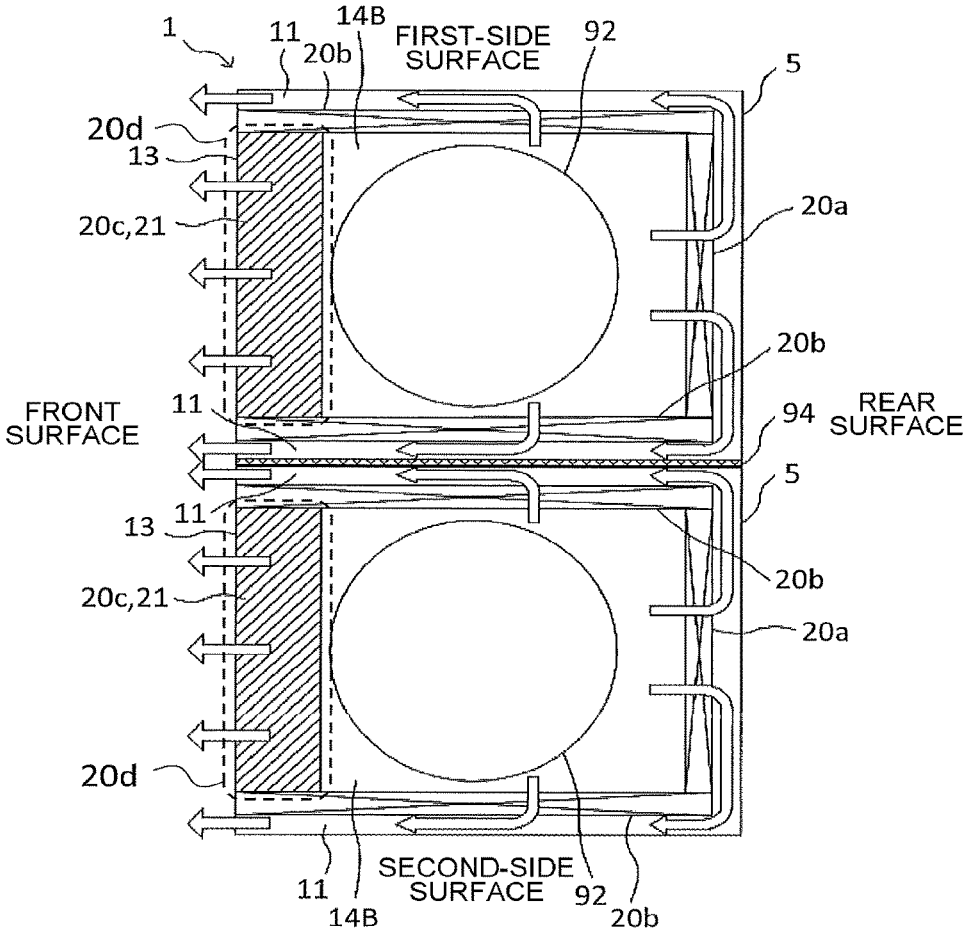
FIG. 40 is a cross-sectional view schematically illustrating an example of a cross section taken along line A-A in FIG. 39.

FIG. 39 is a side view schematically illustrating a condensation unit 1 of an air-conditioning apparatus according to Embodiment 9 of the present disclosure. FIG. 40 is a cross-sectional view schematically illustrating an example of a cross section taken along line A-A in FIG. 39. Embodiment 9 will be described with reference to FIGS. 39 and 40. In FIGS. 39 and 40, the flows of air are indicated by arrows.

In Embodiment 9, as illustrated in FIG. 40, a plurality of fans 92 are provided, and a second partition plate 94 is provided to partition space in which the fans 92 are provided. In this regard, Embodiment 9 is different from Embodiment 8. To be more specific, in Embodiment 9, two fans 92 are arranged in the lateral direction of a housing 5 as in Embodiment 8. In addition, in Embodiment 9, the second partition plate 94 is provided between the two fans 92, and two side heat exchangers 20*b* and two side air passages 11 are provided for the fans 92; that is, for the fans 92, respective side heat exchangers 20*b* and respective side air passages 11 are provided. Because of the provision of the second partition plate 94 between the fans 92, for spaces into which the above space is partitioned by the second partition plate 94, respective air passages 11 are provided.

Because of the above configuration, in the air-conditioning apparatus according to Embodiment 9, the total height of a rear heat exchanger 20*a*, the side heat exchanger 20*b*, a first heat exchanger 20*c*, and a second heat exchanger 21 is increased, and the heat exchange performance is increased.

Furthermore, in the air-conditioning apparatus according to Embodiment 9, the pressure loss of air that passes through the rear heat exchanger 20*a*, the side heat exchangers 20*b*, the first heat exchanger 20*c*, and the second heat exchanger 21 can be reduced. As a result, the performance of the whole system can be improved. Furthermore, since the front heat exchanger 20*d* is provided in such a manner as to be V-shaped in cross-sectional view, the number of stages of the first heat exchanger 20*c* and the second heat exchanger 21 can be increased. As a result, the performance of the whole system can be improved.

Embodiment 10

Embodiment 10 of the present disclosure will be described below. With respect to Embodiment 10, components that are the same as or equivalent to those of any of Embodiments 1 to 9 will be denoted by the same reference signs, and of descriptions of the components, descriptions that are the same as those regarding any of Embodiments 1 to 9 will not be repeated.

Figure 41:
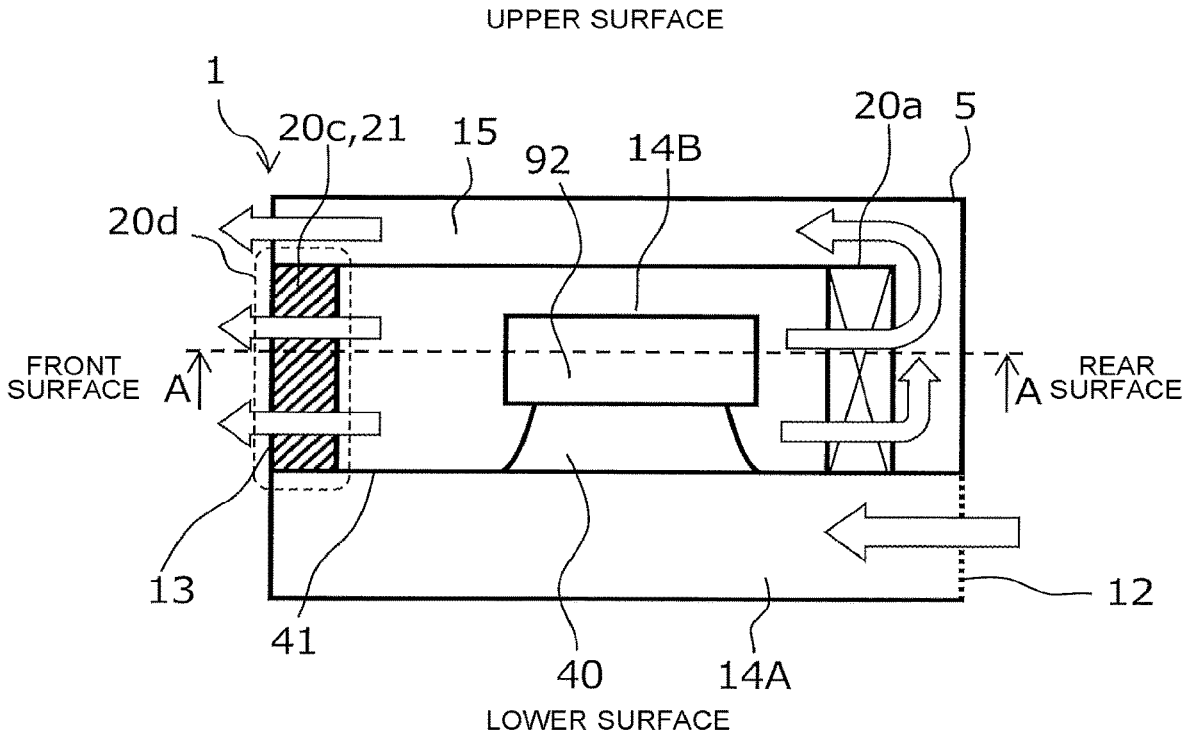
FIG. 41 is a side view schematically illustrating a condensation unit of an air-conditioning apparatus according to Embodiment 10 of the present disclosure.
Figure 42:
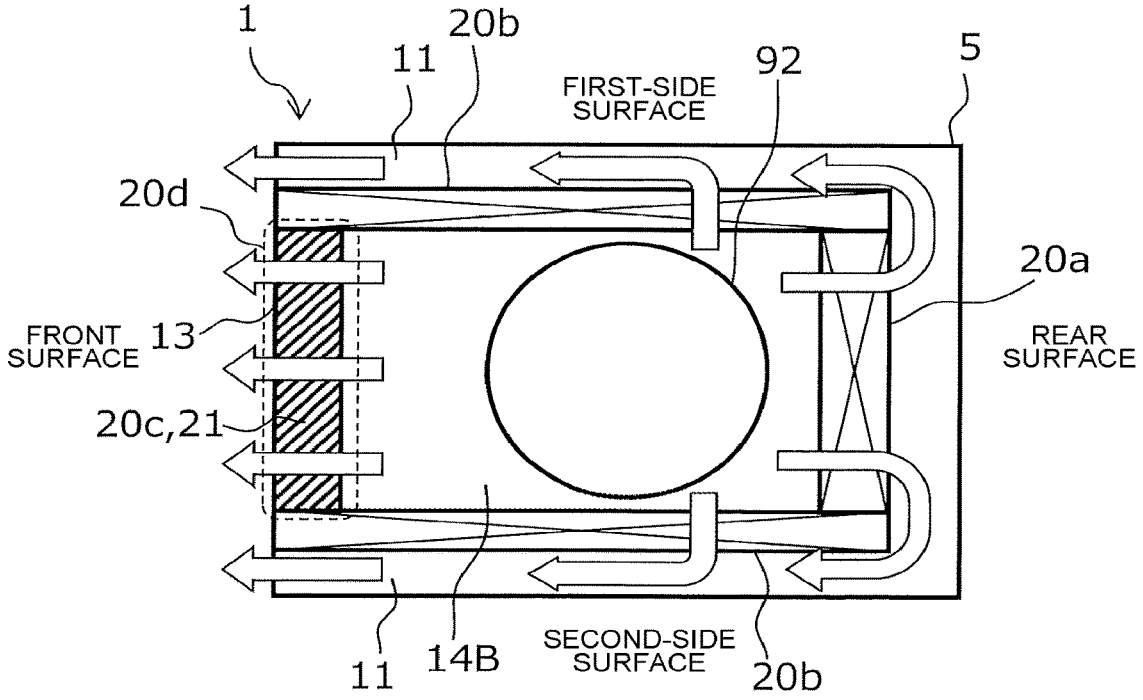
FIG. 42 is a cross-sectional view schematically illustrating an example of a cross section taken along line A-A in FIG. 41.

FIG. 41 is a side view schematically illustrating a condensation unit 1 of an air-conditioning apparatus according to Embodiment 10 of the present disclosure. FIG. 42 is a cross-sectional view schematically illustrating an example of a cross section taken along line A-A in FIG. 41. Embodiment 10 will be described with reference to FIGS. 41 and 42. In FIGS. 41 and 42, the flows of air are indicated by arrows.

In Embodiment 10, as illustrated in FIG. 41, an upper surface air passage 15 is provided on an upper surface side of a housing 5. In this regard, Embodiment 10 is different from Embodiments 1 to 9. To be more specific, in Embodiments 1 to 9, air that has passed through a rear heat exchanger 20*a* flows out from an air outlet 13 after flowing through a side air passage 11 only. By contrast, in Embodiment 10, air that has passed through the rear heat exchanger 20*a* flows out from the air outlet 13 after flowing through the side air passage 11 or the upper surface air passage 15.

Because of the above configuration, in the air-conditioning apparatus according to Embodiment 10, the flow resistance of air that has passed through the rear heat exchanger 20*a* is decreased. Thus, the difference between the amounts of air that passes through the front heat exchanger 20*d*, the side heat exchangers 20*b*, and the rear heat exchanger 20*a* is reduced. As a result, the performance of the whole system can be improved.

Figure 43:
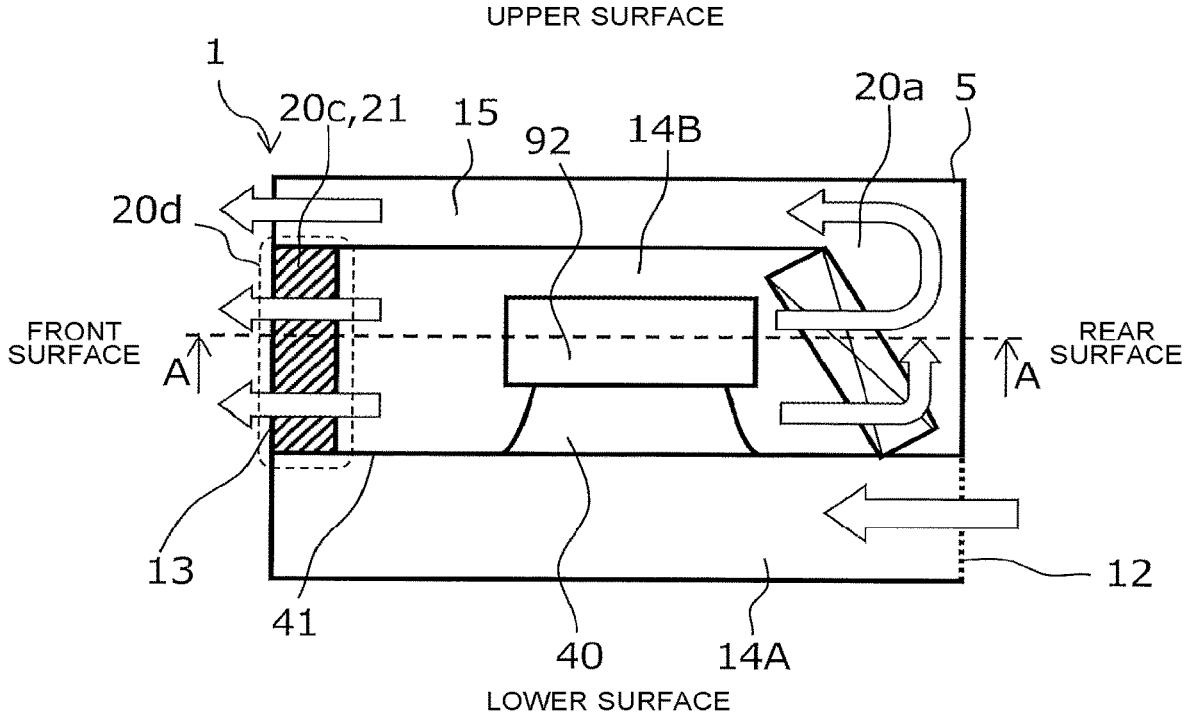
FIG. 43 is a side view schematically illustrating a condensation unit of the air-conditioning apparatus according to Embodiment 10 of the present disclosure.
Figure 44:
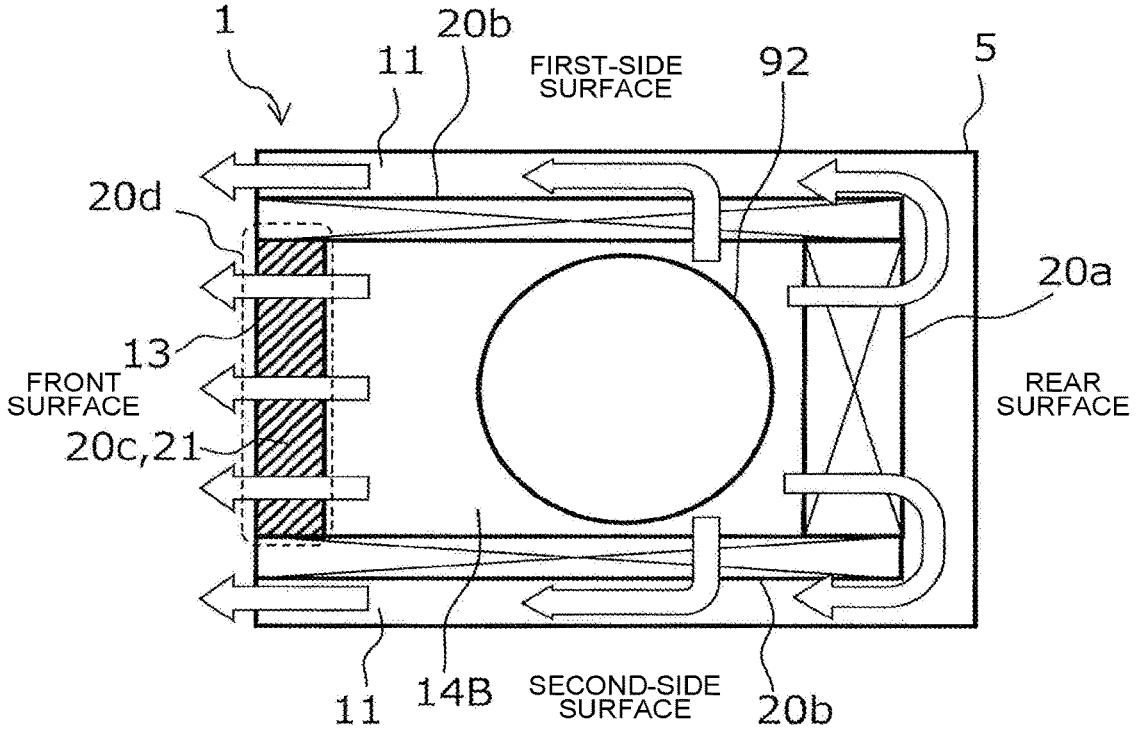
FIG. 44 is a cross-sectional view schematically illustrating an example of a cross section taken along line A-A in FIG. 43.

As illustrated in FIGS. 43 and 44, in the case where the rear heat exchanger 20*a* is inclined in cross-sectional view, the pressure loss of air that passes through the rear heat exchanger 20*a* can be reduced. Because of this configuration, the variation between the amounts of air that passes through the front heat exchanger 20*d*, the rear heat exchanger 20*a*, and the side heat exchangers 20*b* is reduced to a smaller value. As a result, the performance of the whole system can be improved. The side heat exchangers 20*b* may be inclined in cross-sectional view. In this case, the pressure loss of air that passes through the side heat exchangers 20*b* can be reduced.

Figure 45:
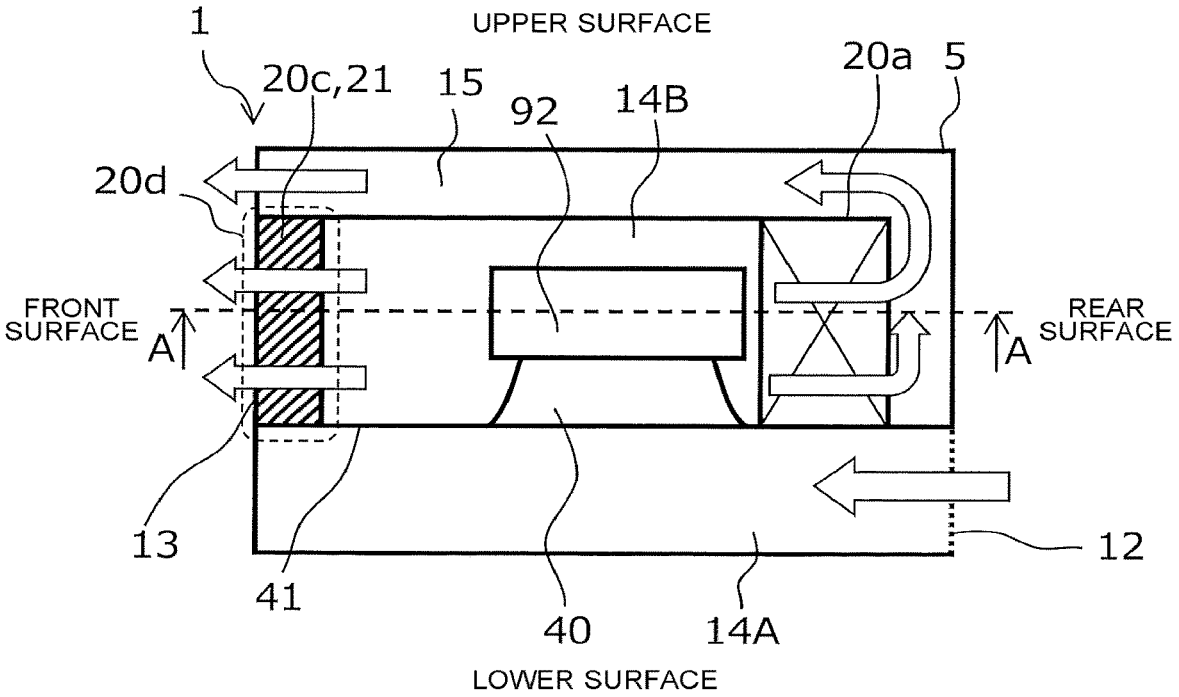
FIG. 45 is a side view schematically illustrating a condensation unit of the air-conditioning apparatus according to Embodiment 10 of the present disclosure.
Figure 46:
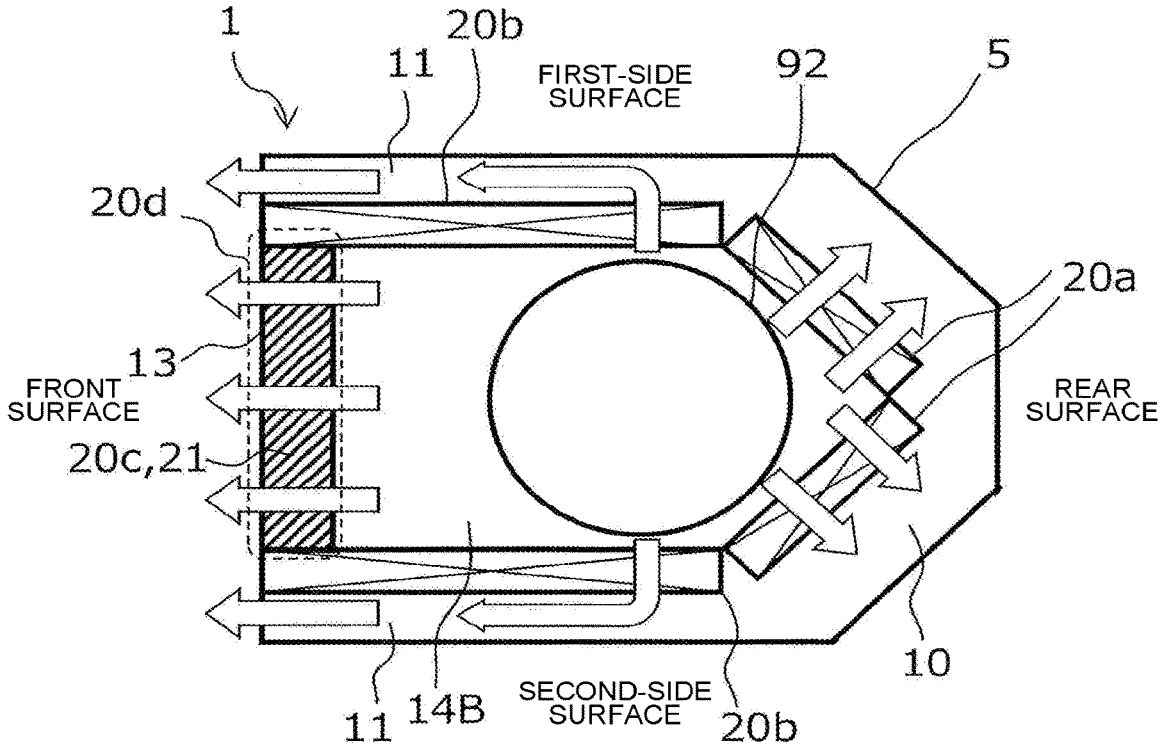
FIG. 46 is a cross-sectional view schematically illustrating an example of a cross section taken along line in FIG. 45.

In the case where a rear air passage 10 is formed in accordance with the shape of the rear heat exchanger 20*a* as illustrated in FIGS. 45 and 46, the pressure loss of air that passes through the rear heat exchanger 20*a* can be reduced. Because of this configuration, the variation between the flow amounts of air that passes through the front heat exchanger 20*d*, the rear heat exchanger 20*a*, and the side heat exchangers 20*b* is reduced to a smaller value. As a result, the performance of the whole system can be improved.

REFERENCE SIGNS LIST condensation unit, 2 evaporation unit, 5 housing, 10 rear air passage, 11 side air passage, 12 air inlet, 13 air outlet, 14A intake air passage, 14B blowout air passage, 15 upper surface air passage, 20*a* rear heat exchanger, 20*b* side heat exchanger, 20*c* first heat exchanger, 20*d* front heat exchanger, 21 second heat exchanger, 22 heat transfer pipe, 23 heat transfer fin, 24 refrigerant distributor, 40 bell mouth, 41 first partition plate, 50 refrigerant pipe, 91 compressor, 92 fan, 93 expansion device, 94 second partition plate, 100 air-conditioning apparatus

The invention claimed is:

1. An air-conditioning apparatus comprising:

a housing in which an intake air passage and a blowout air passage are provided, the intake air passage communicating with an air inlet, the blowout air passage communicating with an air outlet that allows air to be blown out in a single direction;

a fan provided in the housing and configured to suck air from the air inlet through the intake air passage and blow out air from the air outlet;

a front heat exchanger provided to face the air outlet of the housing; and at least one of a rear heat exchanger and a side heat exchanger, the rear heat exchanger being provided to face a rear surface of the housing, the side heat exchanger being provided to face a side surface of the housing;

wherein the fan is configured to blow air that is sucked into the fan from the air inlet and the intake air passage, in a circumferential direction perpendicular to a direction in which the air is sucked into the fan, such that some of the air blown out from the fan is blown out from the air outlet via the at least one of the rear heat exchanger and the side heat exchanger, and a remaining portion of the air is blown out from the air outlet through the blowout air passage and the front heat exchanger, wherein the front heat exchanger includes a first heat exchanger and a second heat exchanger, and when the front heat exchanger operates as a condenser, the first heat exchanger operates as a condenser, and in the second heat exchanger, condensed and liquified refrigerant flows, and wherein when the front heat exchanger and the at least one of the rear heat exchanger and the side heat exchanger operate as condensers, the second heat exchanger is located downstream of the first heat exchanger and the at least one of the rear heat exchanger and the side heat exchanger in a flow direction of refrigerant.

2. The air-conditioning apparatus of claim 1, wherein in an upper portion of the housing, an upper air passage is provided to guide air that has passed through the rear heat exchanger or the side heat exchanger to the air outlet.

3. The air-conditioning apparatus of claim 1, wherein a center of the fan in a height direction is displaced upwards or downwards from a center of the front heat exchanger in the height direction, and the second heat exchanger is provided closer to the fan than the first heat exchanger and side by side with the first heat exchanger in a direction in which the fan blows air.

4. The air-conditioning apparatus of claim 1, wherein at least one of an upper air passage and a side air passage is provided, the upper air passage being provided in an upper portion of the housing to guide air that has passed through the rear heat exchanger or the side heat exchanger to the air outlet, the side air passage being provided in the housing to guide the air that has passed though the rear heat exchanger or the side heat exchanger to the air outlet; and a rear air passage is provided in a rear surface of the housing to guide air that has passed through the rear heat exchanger to at least one of the upper air passage and the side air passage.

5. The air-conditioning apparatus of claim 1, wherein the side heat exchanger or the rear heat exchanger is provided to be inclined as viewed in a cross-sectional view.

6. The air-conditioning apparatus of claim 1, wherein in a case where the first heat exchanger is provided to be inclined as viewed in a cross-sectional view such that an upper side or a lower side of the first heat exchanger is located closer to the fan than the other of the upper side or the lower side of the first heat exchanger, the second heat exchanger is provided such that a length of the second heat exchanger in a height direction thereof is smaller than that of the first heat exchanger in a height direction thereof, the second heat exchanger is located closer to the fan than the first heat exchanger, and a distance between the first heat exchanger and the second heat exchanger decreases in a direction toward the fan.

7. The air-conditioning apparatus of claim 1, wherein a length of the second heat exchanger in a height direction thereof is smaller than that of the first heat exchanger in a height direction thereof, a length of the second heat exchanger in a lateral direction thereof is smaller than that of the first heat exchanger in a lateral direction thereof, the second heat exchanger is closer to the fan than the first heat exchanger, and in a case where a rotational speed of the fan in the circumferential direction is resolved into a component in the direction perpendicular to the air outlet and. a component in a direction parallel to the air outlet, the second heat exchanger is provided on a line extended from the air outlet in a direction in which the component in the direction perpendicular o the air outlet is maximized.

8. The air-conditioning apparatus of claim 1, further comprising the rear heat exchanger and at least one said side heat exchanger.

9. The air-conditioning apparatus of claim 8, wherein the air outlet is provided in a front surface of the housing and the air inlet is provided in a rear surface of the housing that is an opposite surface of the front surface.

10. The air-conditioning apparatus of claim 1, wherein the air inlet is below the fan and one or more of the front heat exchanger and the at least one of the rear heat exchanger and the side heat exchanger.

11. The air-conditioning apparatus of claim 1, wherein the fan blows the air in the circumferential direction in a direction toward the front heat exchanger and in at least one other direction toward the at least one of the rear heat exchanger and the side heat exchanger.

12. The air-conditioning apparatus of claim 1, wherein the air outlet is provided in a front surface of the housing and the air inlet is provided in only a rear surface of the housing that is an opposite surface of the front surface.

13. The air-conditioning apparatus of claim 1, wherein when the front heat exchanger, the at least one of the rear heat exchanger, and the side heat exchanger operate as condensers, a heat exchanger, which is located downstream of at least one of the rear heat exchanger and the side heat exchanger in the flow direction of refrigerant in the housing, is only the second heat exchanger which is a. part of the front heat exchanger provided to face the air outlet of the housing.

14. The air-conditioning apparatus of claim 1, wherein a partition plate which partitions the intake air passage and the blowout air passage is provided in the housing, and a heat exchanger which operates as a condenser is provided at the blowout air passage, and is not provided at the intake air passage.

* * * * *